US007982145B2

(12) United States Patent
Yuba et al.

(10) Patent No.: US 7,982,145 B2
(45) Date of Patent: Jul. 19, 2011

(54) INSERTING CONNECTOR, RECEIVING CONNECTOR, AND CONNECTOR UNIT

(75) Inventors: Takashi Yuba, Shinagawa (JP); Koichi Kiryu, Shimotakai-gun (JP); Akio Nakamura, Shinagawa (JP); Haruo Mochizuki, Shinagawa (JP); Keiichi Hirose, Minato (JP); Tomonori Iino, Minato (JP)

(73) Assignees: Fujitsu Components Limited, Tokyo (JP); NTT Facilities, Inc., Tokyo (JP)

( * ) Notice: Subject to any disclaimer, the term of this patent is extended or adjusted under 35 U.S.C. 154(b) by 314 days.

(21) Appl. No.: 12/421,687

(22) Filed: Apr. 10, 2009

(65) Prior Publication Data

US 2010/0029111 A1 Feb. 4, 2010

(30) Foreign Application Priority Data

Jul. 30, 2008 (JP) ..... 2008-196921
Sep. 29, 2008 (JP) ..... 2008-251498

(51) Int. Cl.
*H01H 9/00* (2006.01)

(52) U.S. Cl. ..... 200/51 R; 200/51.09; 200/51.11

(58) Field of Classification Search ..... 200/51 R, 200/51.09, 51.11, 51.12
See application file for complete search history.

(56) References Cited

U.S. PATENT DOCUMENTS 4,224,484 A * 9/1980 Haas et al. ..... 200/38 FB
4,356,368 A * 10/1982 Osika ..... 200/307
4,678,254 A 7/1987 Le Magourou
5,734,206 A * 3/1998 Keizer et al. ..... 307/116
6,590,169 B2 * 7/2003 Martinez ..... 200/17 R
7,504,600 B2 * 3/2009 Hallet et al. ..... 200/61.54
7,723,630 B1 * 5/2010 Jordan et al. ..... 200/334
7,754,985 B2 * 7/2010 Gordon et al. ..... 200/1 R
2005/0184856 A1 8/2005 Pourchot
2005/0242770 A1 11/2005 Britto

FOREIGN PATENT DOCUMENTS

DE 203 12 374 U1 10/2003
EP 0 865 114 A 9/1998
GB 437 309 A 10/1935
JP 05-082208 4/1993
JP 8-130054 5/1996
JP 2002-343169 11/2002
JP 2003-031301 1/2003
WO WO 2007/015274 A 2/2007

OTHER PUBLICATIONS

Office Action dated Jan. 6, 2011 issued with respect to the corresponding Korean Patent Application No. 10-2009-0040233.
Extended European Search Report.

* cited by examiner

*Primary Examiner* — Gary F. Paumen
(74) *Attorney, Agent, or Firm* — IPUSA, PLLC

(57) ABSTRACT

An inserting connector connected to a receiving connector, the receiving connector being configured to electrically connect an electric power source and an electric apparatus receiving an electric power supply from the electric power source, the inserting connector being connected to the electric apparatus, the inserting connector includes two electric power plug terminals made of a conductor, the conductor being configured to receive the electric power supply; and a control plug terminal configured to be extended and retracted in an inserting direction.

31 Claims, 15 Drawing Sheets

(a)

(b)

INSERTING CONNECTOR, RECEIVING CONNECTOR, AND CONNECTOR UNIT

CROSS-REFERENCE TO RELATED APPLICATIONS

This patent application is based upon and claims the benefit of priority of Japanese Patent Application No. 2008-196921 filed on Jul. 30, 2008 and Japanese Patent Application No. 2008-251498 filed on Sep. 29, 2008 the entire contents of which are incorporated herein by reference.

BACKGROUND OF THE INVENTION

1. Field of the Invention

The present invention generally relates to inserting connectors, receiving connectors, and connector units. More specifically, the present invention relates to an inserting connector, a receiving connector, and a connector unit which are used for supplying electric power.

2. Description of the Related Art

It is normal practice that an electric apparatus is operated by receiving a supply of electric power from an electric power source. When the electric apparatus receives the supply of the electric power from the electric power source, normally the electric power is supplied from the electric power source to the electric apparatus via a connector unit.

As described in Japanese Laid-Open Patent Application Publication No. 5-82208 and Japanese Laid-Open Patent Application Publication No. 2003-31301, in such a connector unit, a convex-shaped inserting connector and a concave-shaped receiving connector are engaged with each other for electric connection.

On the other hand, as one measure for global warming or the like, even in electric power transmission in a local area, supplying high voltage and direct current electric power has been suggested whereby electric power loss in a voltage transformer or by electric power transmission can be made low and a cable is not required to be thick. In particular, in an information apparatus such as a server, such an electric power supply is desirable because a large amount of electric power is consumed.

If the voltage is high, the electric power supplied to the electric apparatus may influence a human body or operations of electronic components.

In a case where the high voltage electric power is used for the information apparatus such as the server, when the apparatus is installed or at the time of maintenance, operations are performed by humans. Therefore, it is necessary to use, as a connector unit for making electric connection, a connector unit different from that used for a conventional alternating current commercial electric power source.

SUMMARY OF THE INVENTION

Accordingly, embodiments of the present invention may provide a novel and useful inserting connector, receiving connector, and connector unit solving one or more of the problems discussed above.

More specifically, the embodiments of the present invention may provide an inserting connector, a receiving connector, and a connector unit whereby high voltage electric power can be safely supplied.

Another aspect of the present invention may be to provide an inserting connector connected to a receiving connector, the receiving connector being configured to electrically connect an electric power source and an electric apparatus receiving an electric power supply from the electric power source, the inserting connector being connected to the electric apparatus, the inserting connector including:

two electric power plug terminals made of a conductor, the conductor being configured to receive the electric power supply; and a control plug terminal configured to be extended and retracted in an inserting direction;

wherein the receiving connector is connected to the electric power source;

the receiving connector includes two electric power jack terminals corresponding to the electric power plug terminals, a control jack terminal corresponding to the control plug terminal, and a relay connected to the control jack terminal, and the relay is operated by extending the control plug terminal in the inserting direction, so that the electric power is supplied to the electronic apparatus via the electric power plug terminal and the electric jack terminal.

Another aspect of the present invention may be to provide a receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector including:

two electric power jack terminals corresponding to the electric power plug terminals;

a control jack terminal corresponding to the control plug terminal; and a relay connected to the control jack terminal, wherein the relay is operated by extending the control plug terminal in the inserting direction, so that the electric power is supplied to the electronic apparatus via the electric power plug terminal and the electric jack terminal.

Another aspect of the present invention may be to provide a receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector including:

two electric power jack terminals corresponding to the electric power plug terminals;

a control jack terminal corresponding to the control plug terminal; and a relay including at least one coil and two relay contacts, wherein the two relay contacts are simultaneously connected by flowing an electric current to the coil;

the two relay contacts are connected, corresponding to the two electric power jack terminals;

the electric power source is configured to supply the electric power from the electric jack terminals via the two relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

Another aspect of the present invention may be to provide a receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector including:

two electric power jack terminals corresponding to the electric power plug terminals;

a control jack terminal corresponding to the control plug terminal; and two relays, each of the relays including a coil and a relay contact, wherein the relay contacts are connected by flowing an electric current to the coils;

the relay contacts of the two relays are connected, corresponding to the two electric power jack terminals;

the electric power source is configured to supply the electric power from the electric power jack terminals via the relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, the electric current flows in the coils, and thereby the two relay contacts are connected and the electric power is supplied to the electronic apparatus.

Another aspect of the present invention may be to provide a connector unit configured to electrically connect an electric power source and an electric apparatus receiving an electric power supply from the electric power source, the connector unit including:

an inserting connector connected to the electronic apparatus; and a receiving connector connected to the electric power source, wherein the inserting connector includes two electric power plug terminals made of a conductor, the conductor being configured to receive the electric power supply; and a control plug terminal configured to be extended and retracted in an inserting direction;

the receiving connector includes two electric power jack terminals corresponding to the electric power plug terminals, a control jack terminal corresponding to the control plug terminal, and a relay connected to the control jack terminal; wherein the relay is operated by extending the control plug terminal in the inserting direction so that the electric power is supplied to the electronic apparatus via the electric power plug terminal and the electric jack terminal.

Another aspect of the present invention may be to provide a connector unit configured to electrically connect an electric power source and an electric apparatus receiving an electric power supply from the electric power source, the connector unit including:

an inserting connector connected to the electronic apparatus; and a receiving connector connected to the electric power source, wherein the inserting connector includes two electric power plug terminals made of a conductor, the conductor being configured to receive the electric power supply, and a control plug terminal configured to be extended and retracted in an inserting direction;

the receiving connector includes two electric power jack terminals corresponding to the electric power plug terminals;

a control jack terminal corresponding to the control plug terminal; and a relay including at least one coil and two relay contacts, wherein the two relay contacts are simultaneously connected by flowing an electric current to the coil;

the two relay contacts are connected, corresponding to the two electric power jack terminals;

the electric power source is configured to supply the electric power from the electric jack terminals via the two relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

Another aspect of the present invention may be to provide a connector unit configured to electrically connect an electric power source and an electric apparatus receiving an electric power supply from the electric power source, the connector unit including:

an inserting connector connected to the electronic apparatus; and a receiving connector connected to the electric power source, wherein the inserting connector includes two electric power plug terminals made of a conductor, the conductor being configured to receive the electric power supply, and a control plug terminal configured to be extended and retracted in an inserting direction;

the receiving connector includes two electric power jack terminals corresponding to the electric power plug terminals;

a control jack terminal corresponding to the control plug terminal; and two relays, each of the relays including a coil and a relay contact, the relay contacts are connected by flowing an electric current to the coil;

the relay contacts of the two relays are connected, corresponding to the two electric power jack terminals;

the electric power source is configured to supply the electric power from the electric jack terminal via the relay contact;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 15 of embodiments of the present invention.

First Embodiment

Figure 1:
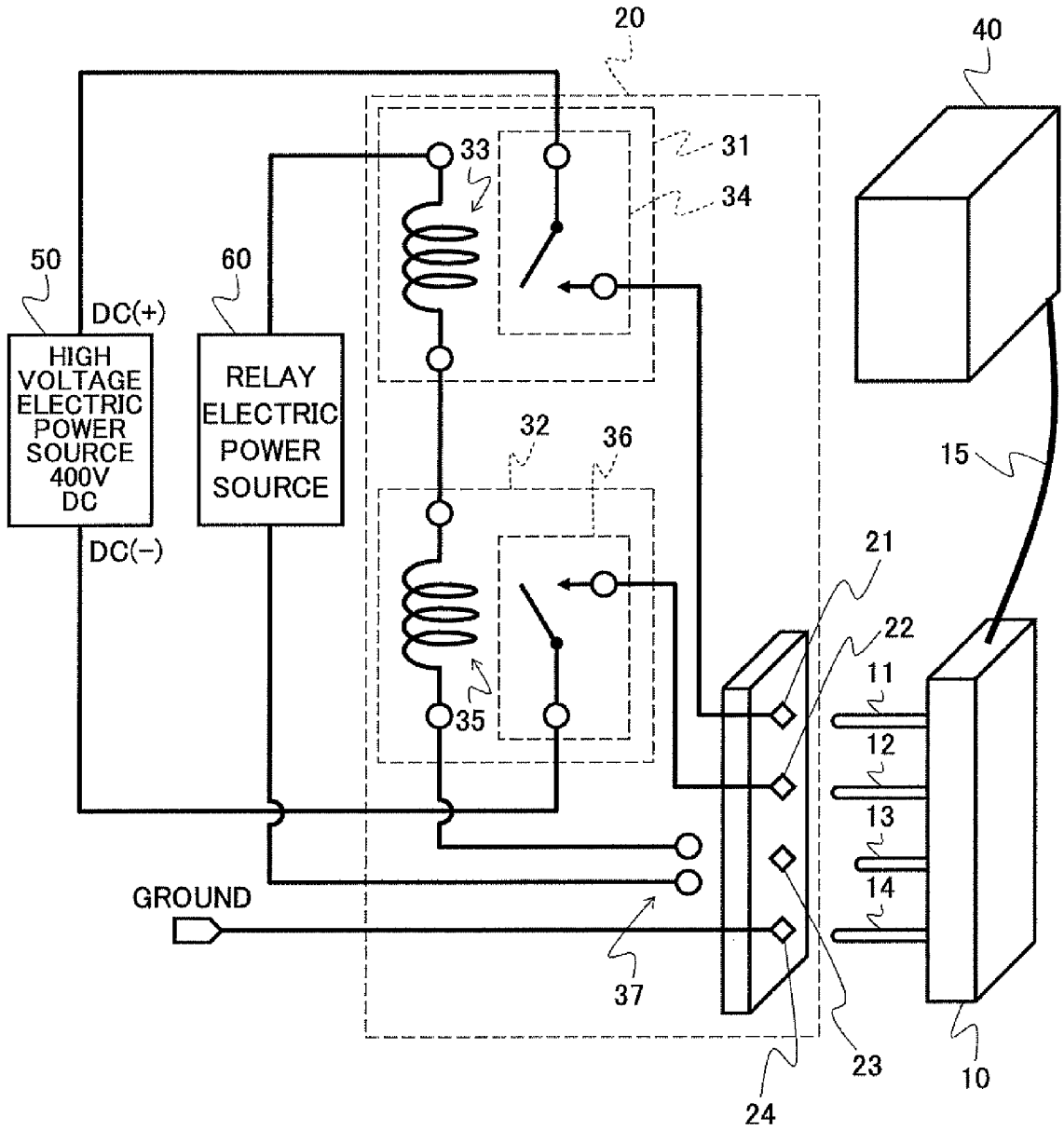
FIG. 1 is a structural diagram of a connector unit of a first embodiment of the present invention.

An inserting connector, a receiving connector, and a connector unit of a first embodiment of the present invention are discussed with reference to FIG. 1. Here, FIG. 1 is a structural diagram of the connector unit of the first embodiment of the present invention.

The connector unit of the first embodiment of the present invention includes an inserting connector 10 and a receiving connector 20.

The inserting connector 10 is connected to an information apparatus 40 such as a server. The inserting connector 10 includes two electric power plug terminals 11 and 12, a control plug terminal 13, and a ground plug terminal 14. The control plug terminal 13 can be retracted in an inserting direction of the inserting connector 10.

On the other hand, the receiving connector 20 is connected to a high voltage electric power source 50 configured to supply the electric power. The receiving connector 20 includes electric power jack terminals 21 and 22 corresponding to the electric power plug terminals 11 and 12, a control jack terminal 23 corresponding to the control plug terminal 13, and a ground jack terminal 24 corresponding to the ground plug terminal 14.

In addition, the receiving connector 20 includes two relays 31 and 32.

The relay 31 includes a coil 33 and a relay contact 34. The relay contact 34 is closed and connected by supplying an electric current to the coil 33. When electric current does not flow in the coil 33, the relay contact 34 is opened and not connected.

The relay 32 includes a coil 35 and a relay contact 36. The relay contact 36 is closed and connected by supplying an electric current to the coil 35. When the electric current does not flow in the coil 35, the relay contact 36 is opened and not connected.

One end of the relay contact 34 is connected to a positive output of the high voltage electric power source 50. Another end of the relay contact 34 is connected to the electric power jack terminal 21. On the other hand, one end of the relay contact 36 is connected to a negative output of the high voltage electric power source 50. Another end of the relay contact 36 is connected to the electric power jack terminal 22.

The receiving connector 20 is connected to a relay electric power source 60. The relay electric power source 60 is configured to drive the relays 31 and 32.

More specifically, a terminal of the coil 33 in the relay 31 is connected to a terminal of the coil 35 in the relay 32. The coil 33 in the relay 31 and the coil 35 in the relay 32 are connected to each other in series.

In addition, another terminal of the coil 33 is connected to a terminal of the relay electric power source 60. Another terminal of the coil 35 and another terminal of the relay electric power source 60 are connected to a control switch 37.

In the control switch 37, a contact is connected by extending the control plug terminal 13 of the inserting connector 10 in the inserting direction in a state where the inserting connector 10 and the receiving connector 20 are engaged with each other.

Thus, by connecting the contact of the control switch 37, an electric current flows from the relay electric power source 60 to the coil 33 of the relay 31 and the coil 35 of the relay 32 so that the relay contacts 34 and 36 are closed. As a result of this, electric power is supplied to the electric power jack terminals 21 and 22 in the receiving connector 20. In addition, the electric power is supplied to the information apparatus 40 such as a server via the electric power plug terminals 11 and 12 of the inserting connector 10.

Thus, in the connector unit of the embodiment of the present invention, the relay contact 34 of the relay 31 is connected to the electric power jack terminal 21, and the relay contact 36 of the relay 32 is connected to the electric power jack terminal 22. In a case of direct current electric power of a high voltage higher than 48 V, more specifically, a high voltage equal to or higher than 200 V, there may be danger to the human body due to the contact. Accordingly, by connecting the relay contacts 34 and 36 to the electric power jack terminals 21 and 22, the supply of the electric power from the electric power jack terminals 21 and 22 is controlled so that safety is further improved.

It is not always necessary that the control switch 37 be a switch per se. In other words, a structure where another terminal of the coil 35 and another terminal of the relay electric power source 60 are connected to each other by extending the control plug terminal 13 in the inserting direction may be applied.

Figure 5:
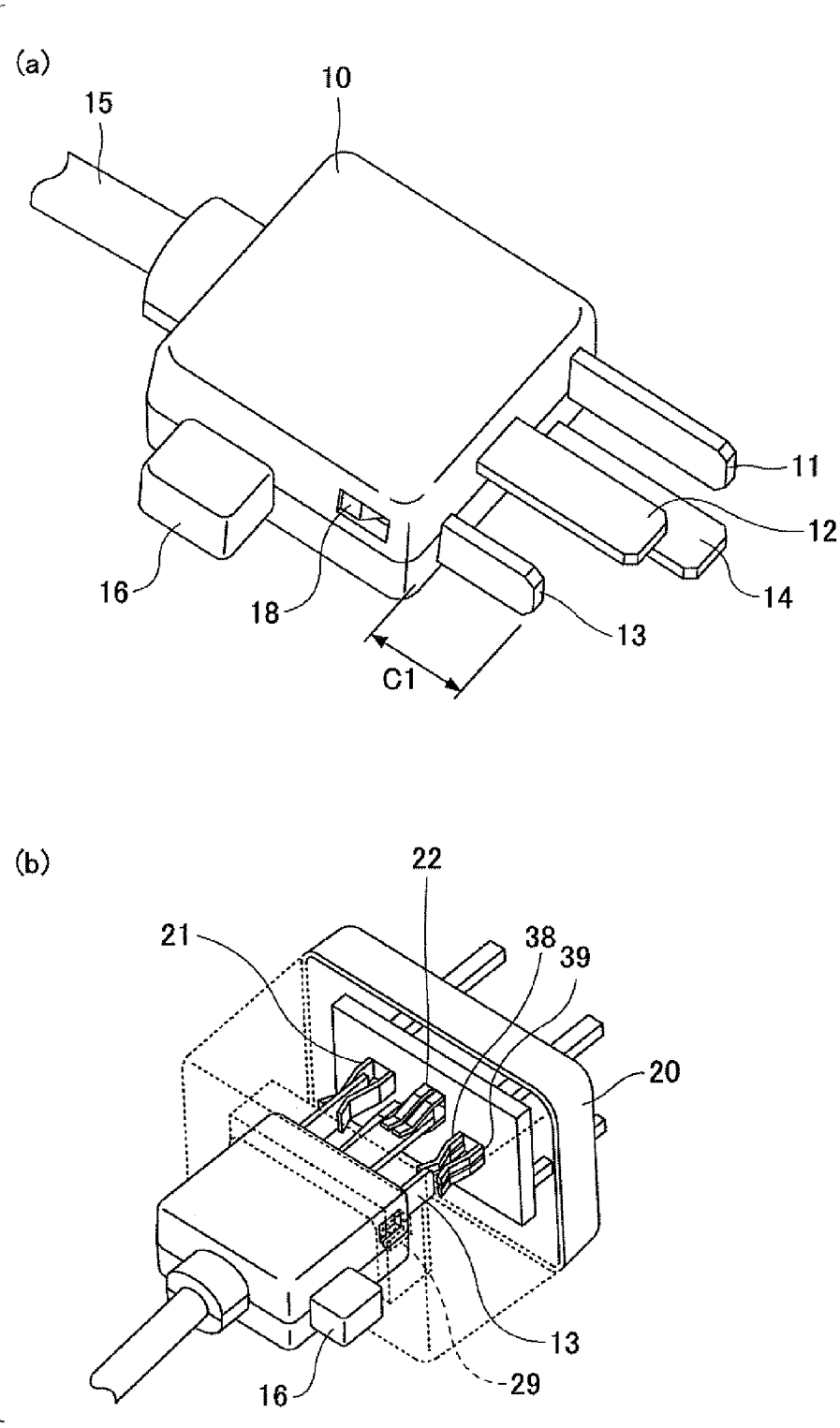
FIG. 5 is a perspective view of a state where a control plug terminal of the connector unit of the first embodiment of the present invention is retracted.
Figure 6:
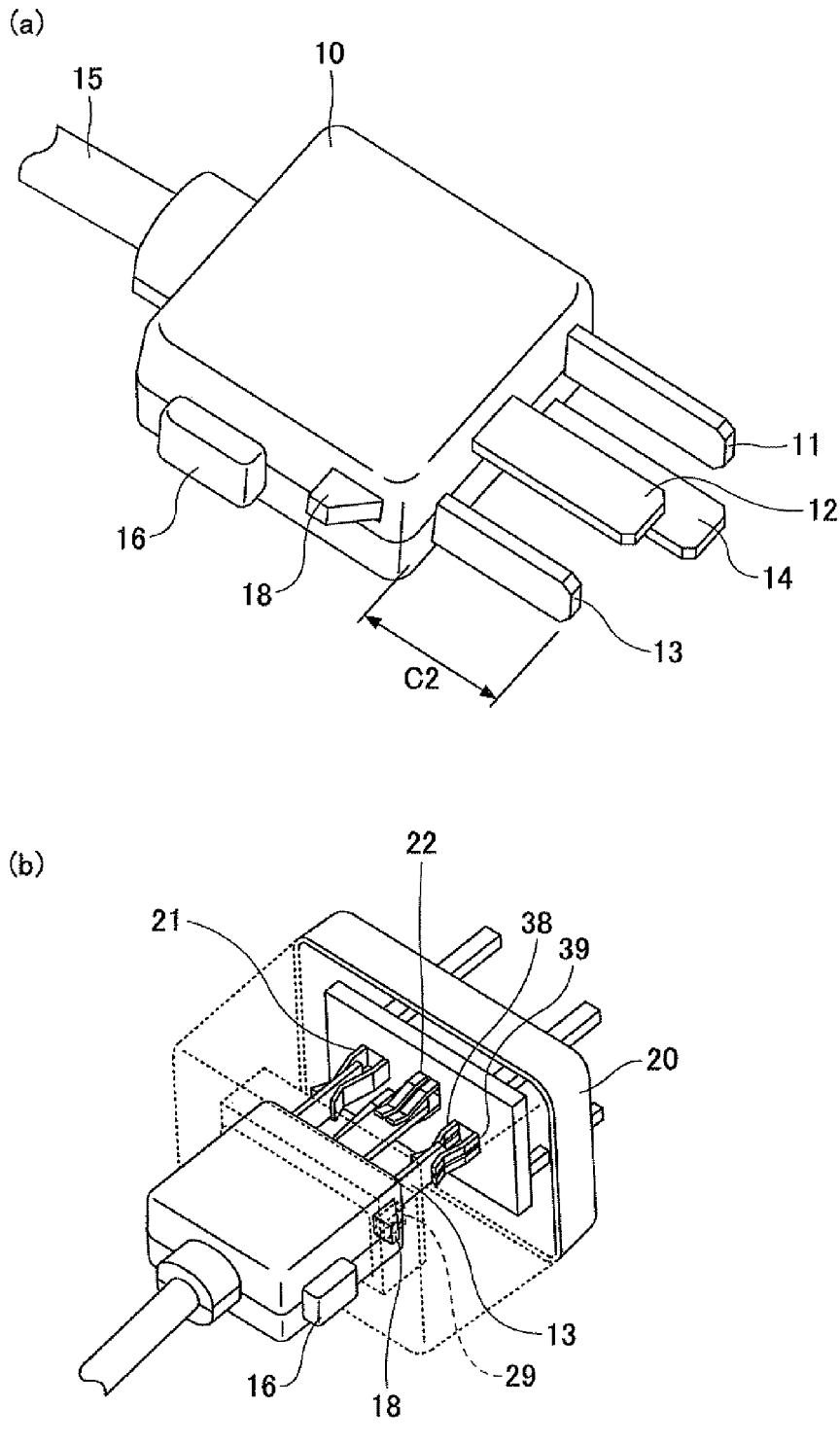
FIG. 6 is a perspective view of a state where the control plug terminal of the connector unit of the first embodiment of the present invention is extended.

More specifically, structures shown in FIG. 5(*b*) and FIG. 6(*b*) can be applied. That is, the electrode 38 connected to the coil 35 shown in FIG. 1 and the electrode 39 connected to the relay electric power source 60 shown in FIG. 1 are provided. The control plug terminal 13 made of a conductive material is extended in the inserting direction so as to come in contact with the electrode 38 and the electrode 39. Another terminal of the coil 35 and another terminal of the relay electric power source 60 are electrically connected to each other via the control plug terminal 13.

In the embodiment of the present invention, the control jack terminal 23 is not limited to having a structure that engages the control plug terminal 13 in a state where the control plug terminal 13 is extended. A structure of the control jack terminal 23 may be where a control switch 37 or the like on and off controlled based on a dynamic force due to extension and retraction of the control plug terminal 13 is included inside.

(Structure of Connector Unit)

Next, a structure and a connecting method of a connector of the embodiment of the present invention are discussed with reference to FIG. 2 through FIG. 6.

Figure 2:
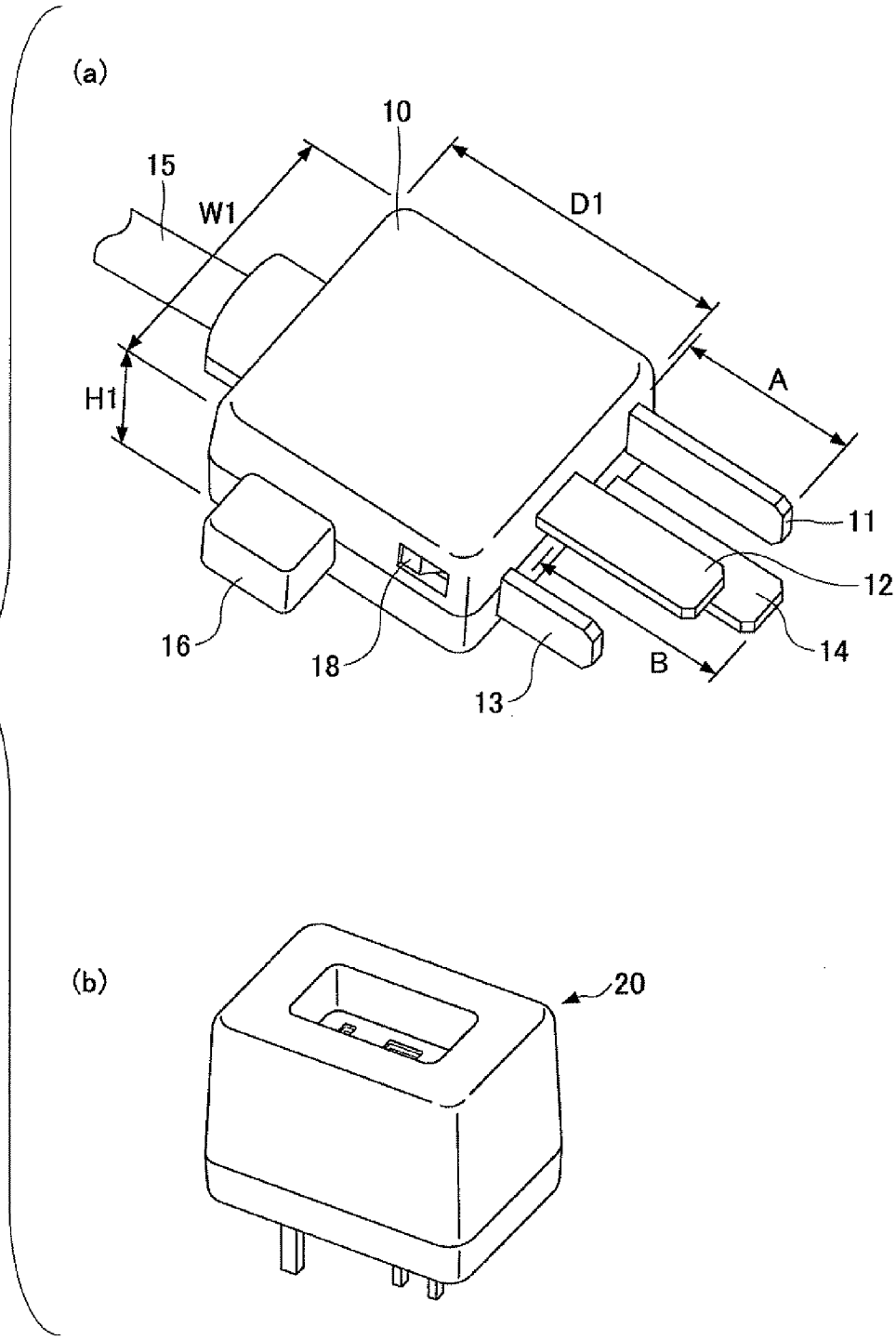
FIG. 2 is a perspective view of the connector unit of the first embodiment of the present invention.

FIG. 2(*a*) is a perspective view of the inserting connector 10 of the embodiment of the present invention. FIG. 2(*b*) is a perspective view of a main body of the receiving connector 20 of the embodiment of the present invention.

Figure 3:
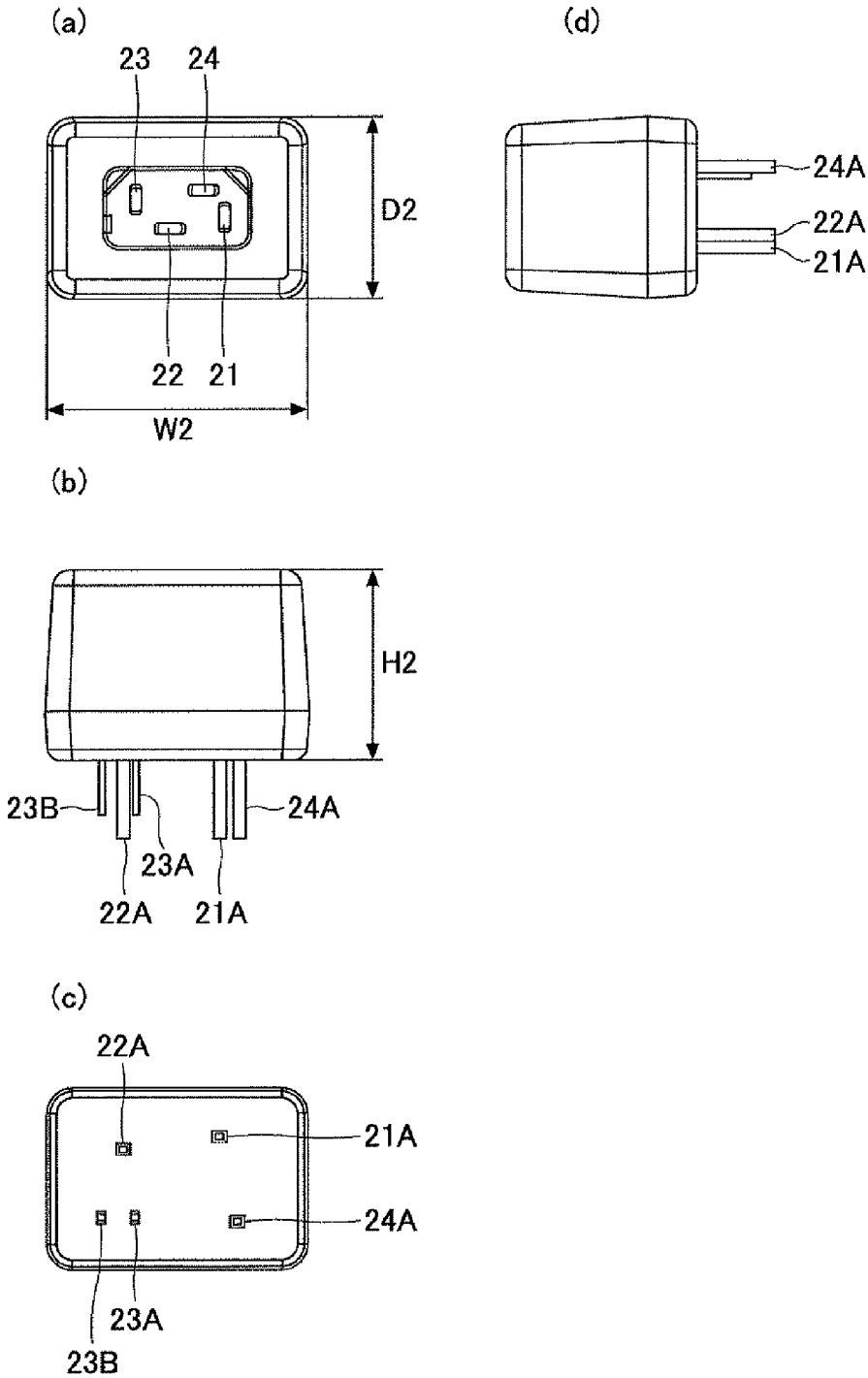
FIG. 3 is a structural view of a receiving connector of the first embodiment of the present invention.

FIG. 3(*a*) is a top view of the main body of the receiving connector 20 of the embodiment of the present invention. FIG. 3(*b*) is a side view in a longitudinal direction of the main body of the receiving connector 20 of the embodiment of the present invention. FIG. 3(*c*) is a rear surface view of the main body of the receiving connector 20 of the embodiment of the present invention. FIG. 3(*d*) is a side view in a short direction of the main body of the receiving connector 20 of the embodiment of the present invention.

Figure 4:
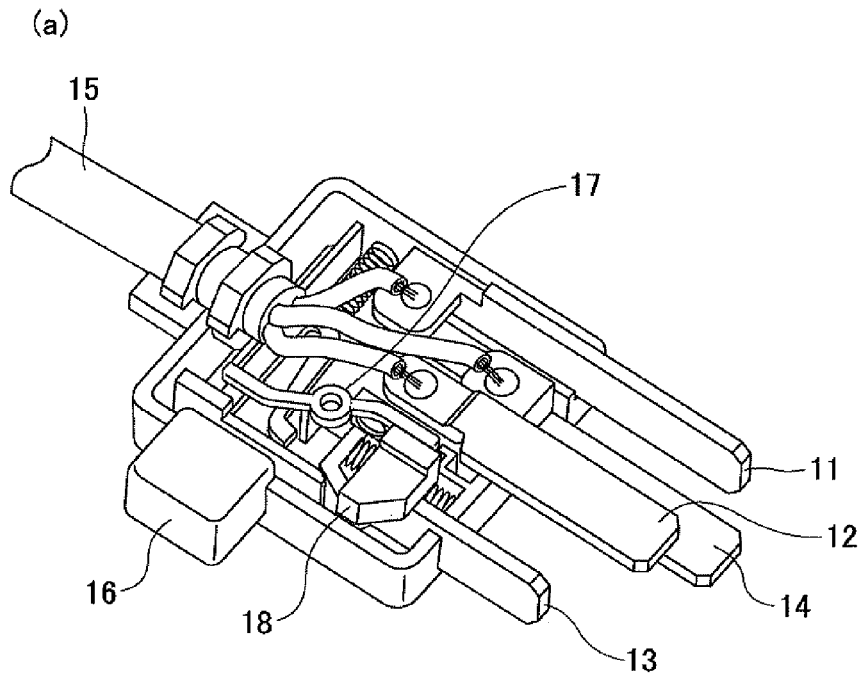
FIG. 4 is a perspective view of an internal structure of an inserting connector of the first embodiment of the present invention.
Figure 4:
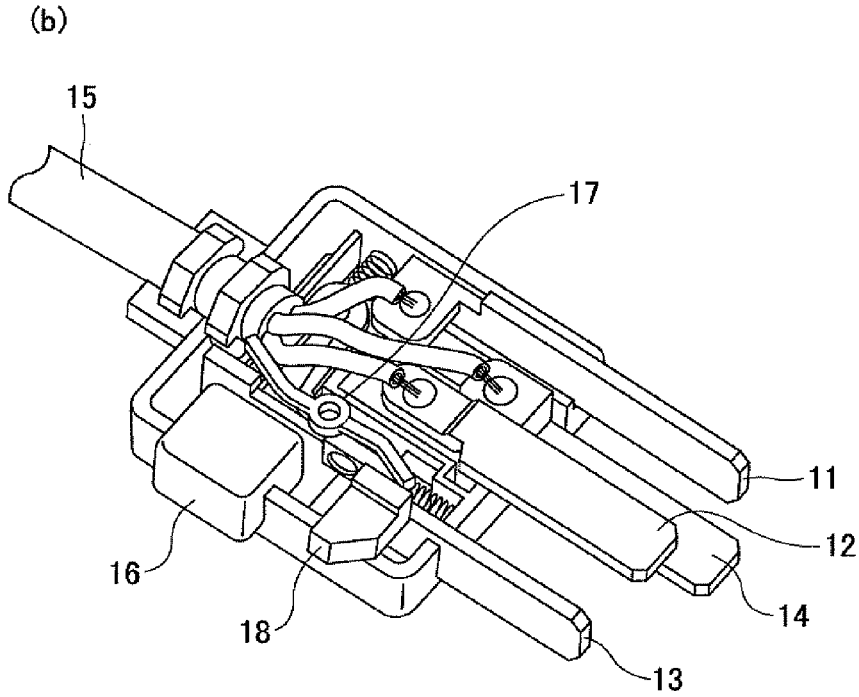

FIG. 4(*a*) is a perspective view of an internal structure of a state where the control plug terminal 13 is retracted in the inserting connector 10 of the embodiment of the present invention. FIG. 4(*b*) is a perspective view of an internal structure of a state where the control plug terminal 13 is extended in the inserting connector 10 of the embodiment of the present invention.

FIG. 5(*a*) is a perspective view of the state where the control plug terminal 13 is retracted in the inserting connector 10 of the embodiment of the present invention. FIG. 5(*b*) is a perspective view of the state where the control plug terminal 13 is retracted when the inserting connector 10 and the receiving connector 20 are connected to each other of the embodiment of the present invention.

FIG. 6(*a*) is a perspective view of the state where the control plug terminal 13 is extended in the inserting connector 10 of the embodiment of the present invention. FIG. 6(*b*) is a perspective view of the state where the control plug terminal 13 is extended when the inserting connector 10 and the receiving connector 20 are connected to each other of the embodiment of the present invention.

The inserting connector 10 shown in FIG. 2(*a*) has width W1 of approximately 30 mm, length D1 of approximately 30 mm, and height H1 of approximately 16 mm. A DC electric power source cable 15 of 400 VDC is connected to the inserting connector 10. The electric power plug terminals 11 and 12, the control plug terminal 13, and the ground plug terminal 14 made of metal are provided at a side of the inserting connector 10 opposite a side where the cable 15 is connected. The length A of the electric power plug terminals 11 and 12 is approximately 17 mm. The length B of the ground plug terminal 14 is approximately 19 mm.

The length C1 of the control plug terminal 13 in the state shown in FIG. 5(*a*) where the control plug terminal 13 is retracted is approximately 10 mm. The length C2 of the control plug terminal 13 in the state shown in FIG. 6(*a*) where the control plug terminal 13 is extended is approximately 14.5 mm.

On the other hand, as shown in FIG. 2(*b*) and FIG. 3, the main body of the receiving connector 20 of the embodiment of the present invention has a structure where a part of the main body of the inserting connector 10 is engaged with the receiving connector 20.

The receiving connector 20 includes the electric power jack terminals 21 and 22, the ground jack terminal 24, and the control jack terminal 23. The electric power jack terminals 21 and 22 are configured to be connected to the electric power plug terminals 11 and 12. The ground jack terminal 24 is configured to be connected to the ground plug terminal 14. The control jack terminal 23 is configured to be connected to the control plug terminal 13 in a state where the control plug terminal 13 is extended. As shown in FIG. 5(*b*) and FIG. 6(*b*), the electrodes 38 and 39 are provided inside the control jack terminal 23.

A terminal connected to a main body of the PDU (Power Distribution Unit) discussed below is provided at a rear surface of the main body of the receiving connector 20. More specifically, an electric power terminal 21A, an electric power terminal 22A, a ground terminal 24A, and control terminals 23A and 23B are provided at the rear surface of the main body of the receiving connector 20. The electric power terminal 21A connects the relay contact 34 of the relay 31 and the electric power jack terminal 21. The electric power terminal 22A connects the relay contact 36 of the relay 32 and the electric power jack terminal 22. The ground terminal 24A is connected to the ground jack terminal 24. The control terminals 23A and 23B are connected to the electrodes 38 and 39 of the control jack terminal 23.

The receiving connector 20 shown in FIG. 3 has width W2 of approximately 56 mm, length D2 of approximately 40 mm, and height H2 of approximately 40.5 mm. Although the relays 31 and 32 are provided outside the main body of the receiving connector 20 in the embodiment of the present invention, the relays 31 and 32 may be provided inside the main body of the receiving connector 20.

In a normal state, the electrodes 38 and 39 provided in the receiving connector 20 do not come in contact with the control plug terminal 13. Only in the state where the control plug terminal 13 is extended, the control plug terminal 13 and the electrodes 38 and 29 come in contact with each other so that the electrodes 38 and 39 are electrically connected to each other via the control plug terminal 13 and thereby an electric current flows.

The inserting connector 10 of the embodiment of the present invention is in the retracted state shown in FIG. 4(*a*) just after the inserting connector 10 is inserted in the receiving connector 20. After this, by pushing a pushing button 16, the control plug terminal 13 extends and a hinge 17 is rotated. As a result of this, a lock terminal 18 projects in a direction perpendicular to the inserting direction so that the extended state shown in FIG. 4(*b*) is formed.

As shown in FIG. 5(*b*), a concave part 29 which corresponds to the projected lock terminal 18 is formed in the receiving connector 20. As shown in FIG. 6(*b*), in the concave part 29, when the lock terminal 18 projects, connection of the inserting connector 10 and the receiving connector 20 cannot be broken.

In the above-discussed embodiment of the present invention, by using the pushing button 16, the control plug terminal 13 is extended in the inserting direction and the lock terminal 18 projects. However, the present invention is not limited to this structure. A slide switch or the like which can move in the inserting direction, instead of the pushing button 16, may be used so that the control plug terminal 13 can be extended in the inserting direction and the lock terminal 18 can project.

Thus, the electric power is supplied from the electric power jack terminals 21 and 22 only in the state where the control plug terminal 13 is extended. This is because it is necessary to prevent the high voltage of 400 VDC from being applied to the electric power jack terminals 21 and 22 of the receiving connector 20 when the inserting connector 10 is not connected to the receiving connector 20.

In other words, if the high voltage of 400 VDC is applied to the electric power jack terminals 21 and 22 of the receiving connector 20 when the inserting connector 10 is not connected to the receiving connector 20, the following problem may occur. That is, when a human touches the electric power jack terminals 21 and 22 in error or makes contact with the electric power jack terminals 21 and 22 via a driver, a metal piece, a cut wire, or the like, the human body may be injured. Hence, it is necessary to prevent such a problem from occurring.

Thus according to the connector unit of the embodiment of the present invention, when the control plug terminal 13 is pushed in a state where the electric power plug terminals 11 and 12 of the inserting connector 10 are engaged with the electric power jack terminals 21 and 22 of the receiving connector 20, an electric current flows via the control switch or the electrodes provided at the control jack terminals 12 and a relay is operated. As a result of this, electric power of 400 VDC is supplied to the electric power jack terminals 21 and 22, and furthermore the electric power is supplied to the information apparatus 40 via the plug terminals 11 and 12 of the inserting connector 10.

(Electric Power Supply System)

Next, a structure of an electric power supply system using the connector unit of the embodiment of the present invention is discussed.

Figure 7:
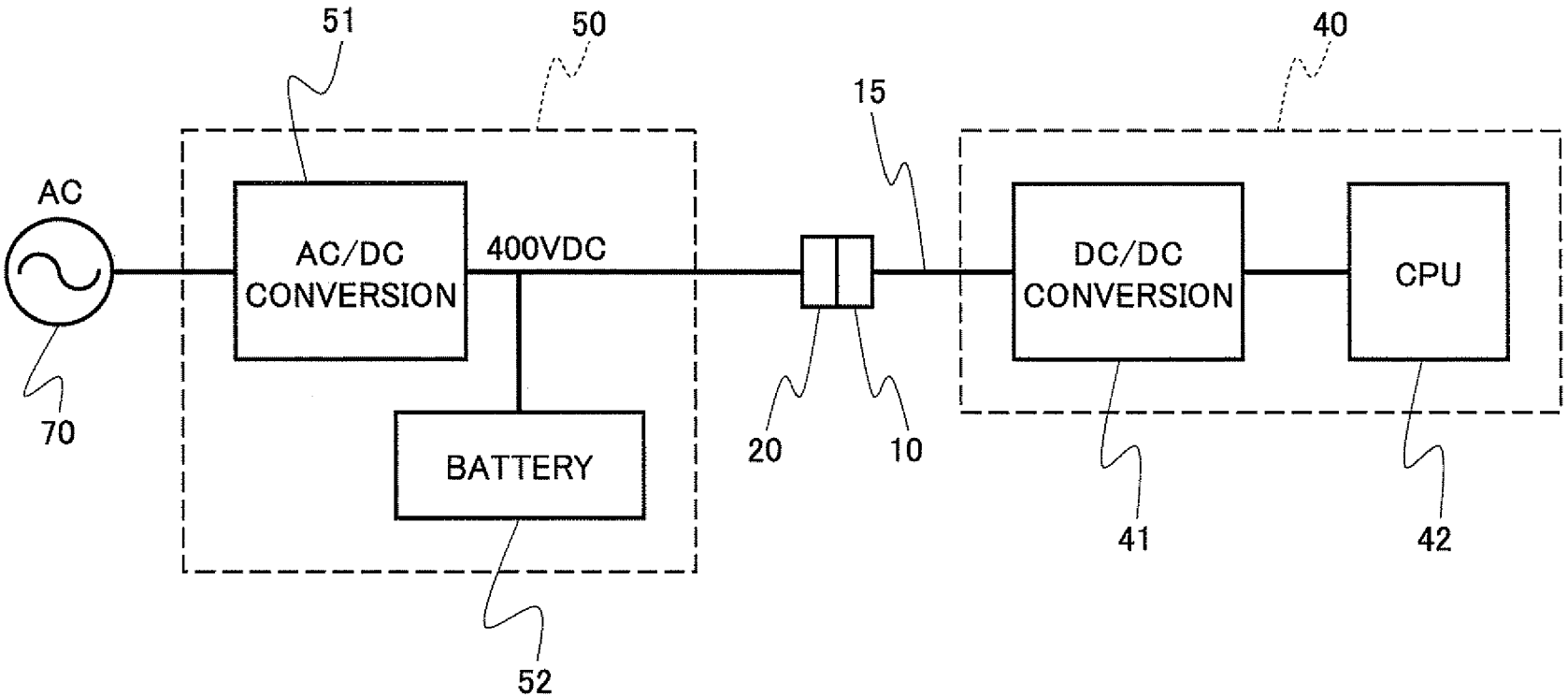
FIG. 7 is a structural diagram of an electric power source supply system using the connector unit of the first embodiment of the present invention.

FIG. 7 is a structural diagram of the electric power source supply system using the connector unit of the first embodiment of the present invention.

In this electric power supply system, a voltage of AC 100 V or AC 200 V supplied from the commercial electric power source 70 is input to the high voltage electric power source 50 in order to be converted to DC 400 V by an AC/DC convertor 51 of the high voltage electric power source 50. Direct current electric energy can be stored in a battery or the like. Therefore, by providing a backup battery 52, it is possible to easily respond in a case of a power outage or the like.

The receiving connector 20 of the embodiment of the present invention is connected to the high voltage electric power source 50 via an electric power source cable, so that electric power of 400 VDC from the high voltage electric power source 50 is supplied from the receiving connector 20.

On the other hand, the inserting connector 10 of the embodiment of the present invention is connected to the information apparatus 40 such as a server via the electric power source cable 15. By electrically connecting the inserting connector 10 and the receiving connector 20, the electric power is supplied from the high voltage electric power source 50 to the information apparatus 40 such as the server.

In addition, a DC/DC convertor 41 is provided in the information apparatus 40 such as the server. The DC/DC convertor 41 is configured to convert 400 VDC to a DC output having a low voltage whereby an electronic component such as the CPU 42 can be operated.

In the above-discussed electric power supply system, there are several advantages. For example, since conversion from the AC of the commercial electric power source 70 to the DC is required only one time, electric power loss is small. In addition, there is no need to pay attention to the width of the wire with a high voltage direct current 400 VDC. Because of the direct current, it is possible to store electric energy in the battery 52 and it is possible to easily respond when the supply from the commercial electric power source 70 stops due to a power outage.

Next, a PDU (Power Distribution Unit) using the connector unit of the embodiment of the present invention is discussed with reference to FIG. 8.

Figure 8:
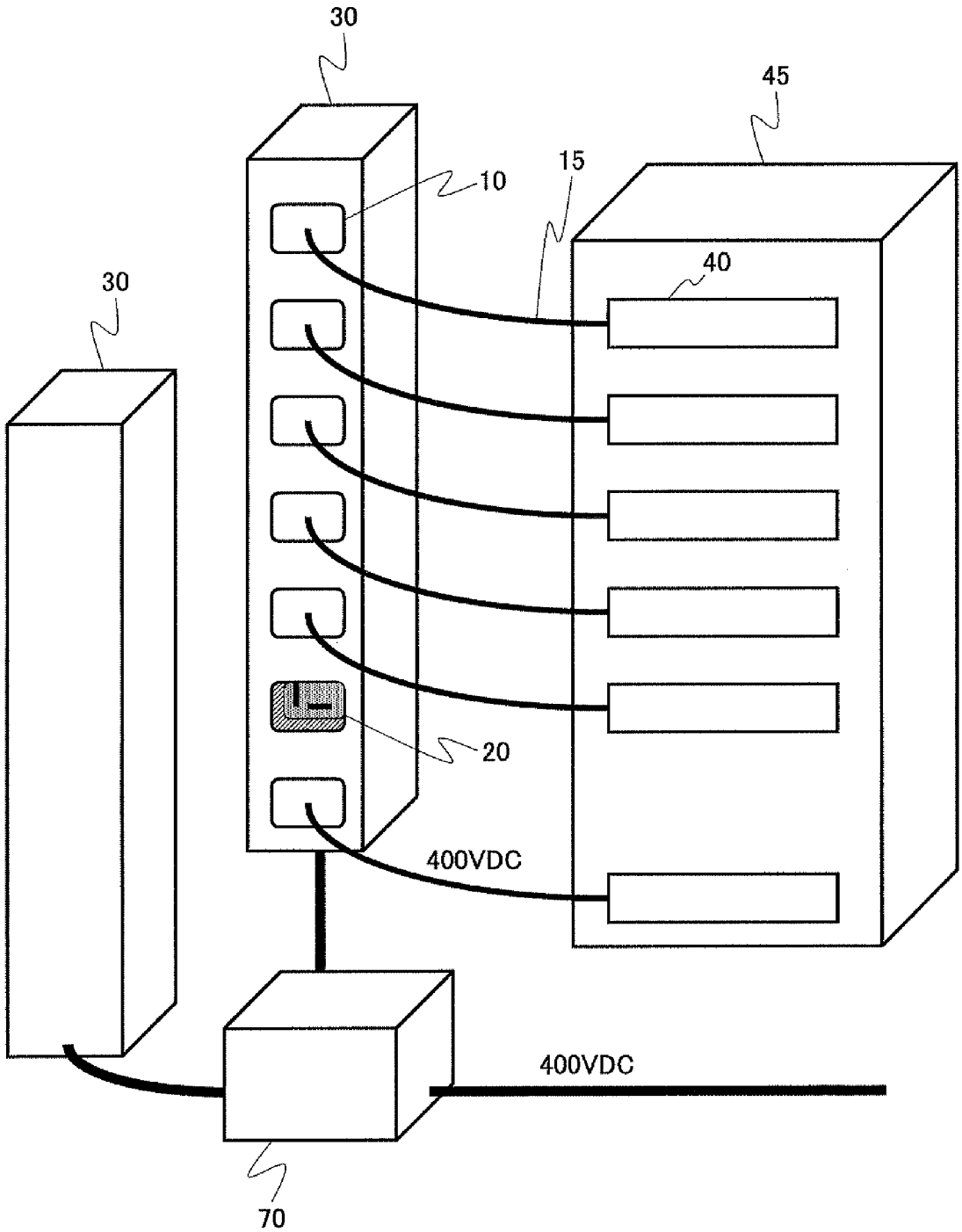
FIG. 8 is a perspective view of a PDU (Power Distribution Unit) using the connector unit of the first embodiment of the present invention.

Here, FIG. 8 is perspective view of the PDU using the connector unit of the first embodiment of the present invention.

The electric power of 400 VDC supplied from the high voltage electric power source shown in FIG. 7 is input to its distribution board 70 for a while so that the electric power is distributed to each PDU 30. Plural of the receiving connectors 20 of the embodiment of the present invention are provided in each PDU 30. It is possible to supply the electric power of 400 VDC via each receiving connector 20.

On the other hand, plural of the information apparatuses 40 such as servers are installed in a server rack 45. The inserting connectors 10 configured to receive a supply of power from the electric power source are connected to the corresponding information apparatuses 40 such as the servers via the DC electric power source cables 15. By electrically connecting the inserting connectors 10 to the receiving connectors 20 provided in the PDU 30, the electric power of 400 VDC can be supplied.

Second Embodiment

Figure 9:
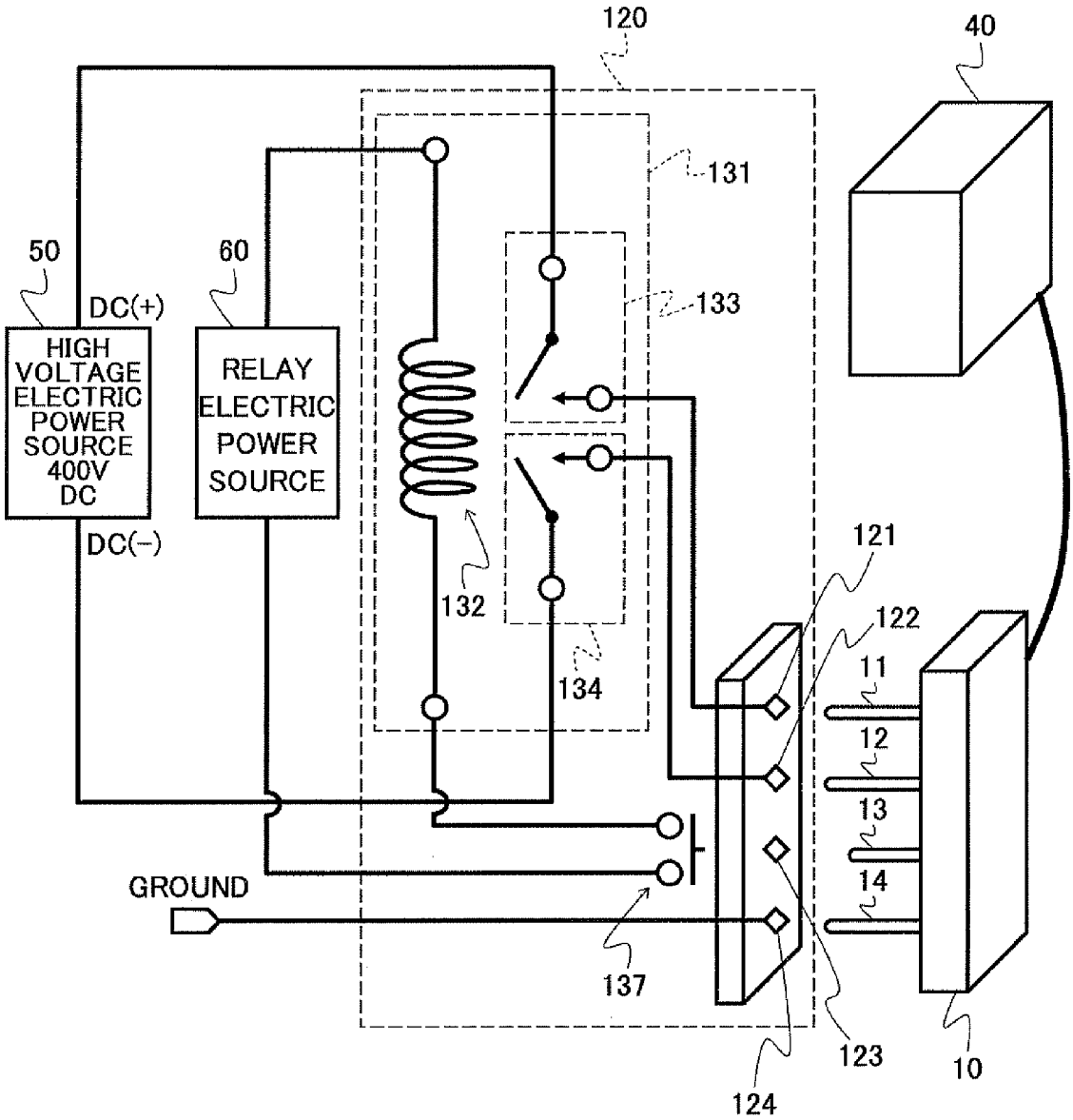
FIG. 9 is a structural diagram of a connector unit of a second embodiment of the present invention.

An inserting connector, a receiving connector, and a connector unit of a second embodiment of the present invention are discussed with reference to FIG. 9. Here, FIG. 9 is a structural diagram of the connector unit of the second embodiment of the present invention.

The connector unit of the second embodiment of the present invention includes an inserting connector 10 and a receiving connector 120.

The inserting connector 10 is connected to an information apparatus 40 such as a server. The inserting connector 10 includes two electric power plug terminals 11 and 12, a control plug terminal 13, and a ground plug terminal 14. The control plug terminal 13 can be retracted in an inserting direction of the inserting connector 10.

On the other hand, the receiving connector 120 is connected to a high voltage electric power source 50 configured to supply the electric power. The receiving connector 120 includes electric power jack terminals 121 and 122 corresponding to the electric power plug terminals 11 and 12, a control jack terminal 123 corresponding to the control plug terminal 13, and a ground jack terminal 124 corresponding to the ground plug terminal 14.

In addition, the receiving connector 120 includes a relay 131 formed of a single coil 132 and two relay contacts 133 and 134. The relay contacts 133 and 134 are closed and connected by supplying an electric current to the coil 132. When the electric current does not flow in the coil 132, the relay contacts 133 and 134 are opened and not connected.

One end of the relay contact 133 is connected to a positive output of a high voltage electric power source 50. Another end of the relay contact 133 is connected to the electric power jack terminal 121. On the other hand, one end of the relay contact 134 is connected to a negative output of the high voltage electric power source 50. Another end of the relay contact 134 is connected to the electric power jack terminal 122.

The receiving connector 120 is connected to a relay electric power source 60. The relay electric power source 60 is configured to drive the relay 131.

More specifically, a terminal of the coil 132 in the relay 131 is connected to a terminal of the relay electric power source 60. In addition, another terminal of the coil 132 and another terminal of the relay electric power source 60 are connected to a control switch 137.

In the control switch 137, the control plug terminal 13 of the inserting connector 10 is extended in the inserting direction in a state where the inserting connector 10 and the receiving connector 120 are engaged with each other, so that electric connection can be made.

Thus by electrically connecting the control switch 137, an electric current flows from the relay electric power source 60 to the coil 132 of the relay 131 so that the relay contacts 133 and 134 are closed. As a result of this, electric power is supplied to the electric power jack terminals 121 and 122 in the receiving connector 120. In addition, the electric power is supplied to the information apparatus 40 such as a server via the electric power plug terminals 11 and 12 of the inserting connector 10.

Thus, in the connector unit of this embodiment of the present invention, the relay contact 133 of the relay 131 is connected to the electric power jack terminal 121, and the relay contact 134 of the relay 131 is connected to the electric power jack terminal 122. In a case of direct current electric power of a high voltage higher than 48 V, more specifically, a high voltage equal to or higher than 200 V, there may be danger for the human body due to the contact. Accordingly, by connecting the relay contacts 133 and 134 to the electric power jack terminals 121 and 122, the supply of the electric power from the electric power jack terminals 121 and 122 is controlled so that the safety is further improved.

It is not always necessary that the control switch 137 be a switch per se. In other words, a structure where another terminal of the coil 132 and another terminal of the relay electric power source 50 are connected to each other by extending the control plug terminal 13 in the inserting direction may be applied.

More specifically, structures shown in FIG. 5(*b*) and FIG. 6(*b*) can be applied. That is, the electrode 38 connected to the coil 132 shown in FIG. 9 and the electrode 39 connected to the relay electric power source 50 shown in FIG. 9 are provided. The control plug terminal 13 made of a conductive material is extended in the inserting direction so as to come in contact with the electrode 38 and the electrode 39. Another terminal of the coil 132 and another terminal of the relay electric power source 50 are electrically connected to each other via the control plug terminal 13.

The connector unit of this embodiment can be applied to the electric power supply system of the first embodiment of the present invention.

Third Embodiment

Next, a receiving connector of the third embodiment of the present invention is discussed with reference to FIG. 1 and FIG. 10.

Figure 10:
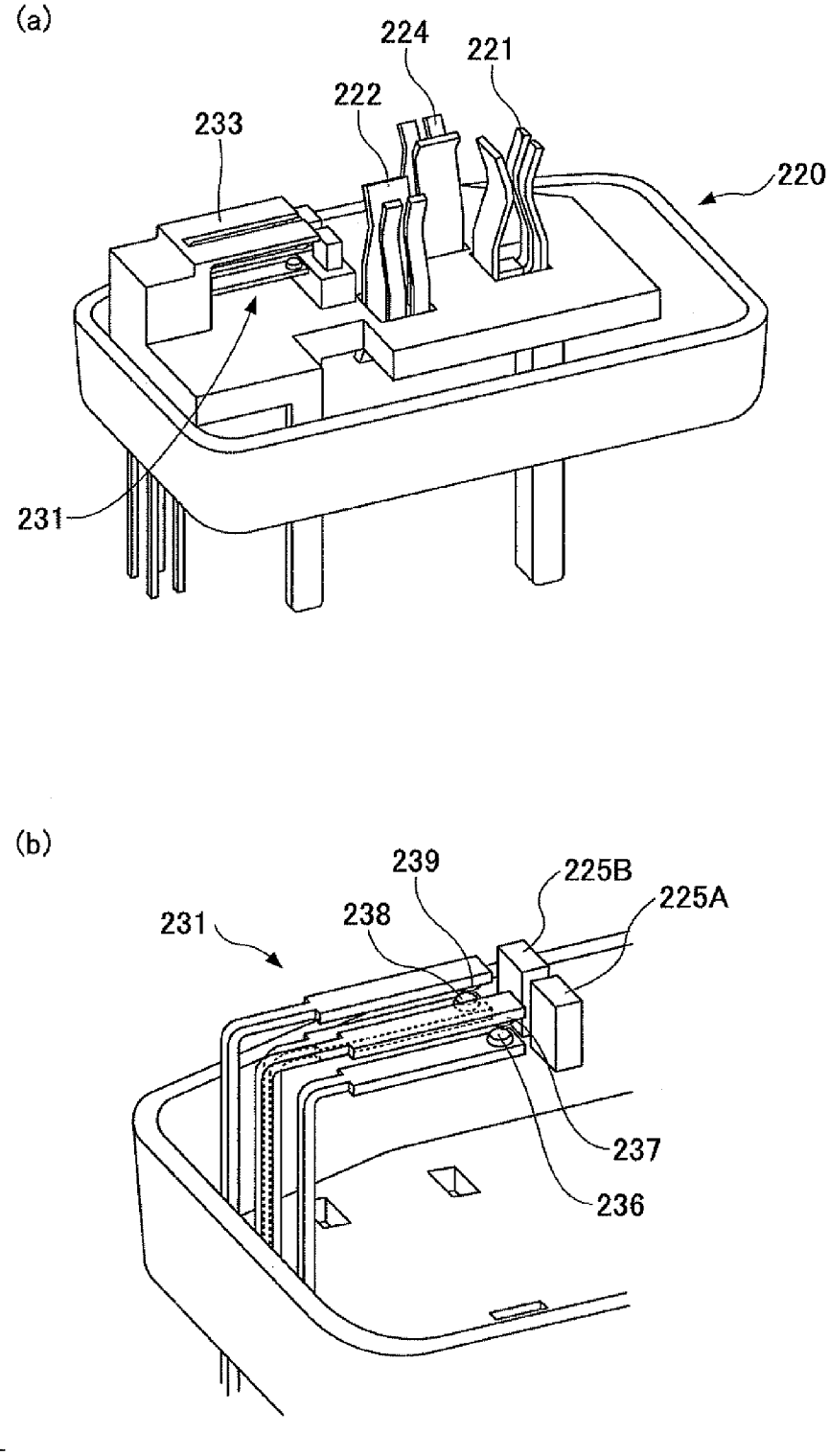
FIG. 10 is a structural view of a receiving connector of a third embodiment of the present invention.

Here, FIG. 10(*a*) is a perspective view of a receiving connector of the third embodiment of the present invention. FIG. 10(*b*) is an expanded view of a main part of the receiving connector of the third embodiment of the present invention.

A receiving connector 220 of this embodiment includes electric power jack terminals 221 and 222 and a ground jack terminal 224. A plate spring switch 231 as a control switch (see the switch 37 shown in FIG. 1) is provided, via an insulation plate spring 233, at the control jack terminal corresponding to the control plug terminal.

The control switch 231 includes two switches, namely, a switch where contacts 236 and 237 are connected and a switch where contacts 238 and 239 are connected. In addition, for preventing arcing, a permanent magnet 225A is provided in the vicinity of the contacts 236 and 237. A permanent magnet 225B is also provided in the vicinity of the contacts 238 and 239.

The contacts 237 and 239 are electrically connected. The contact 236 is connected to the relay electric power source 60 shown in FIG. 1. The contact 238 is connected to the coil 35 of the relay 32 shown in FIG. 1.

The insulation plate spring 233 is bent, in a state where the control plug terminal of the inserting connector (not shown) is extended, so that the contact 237 and the contact 236 of the plate spring switch are connected and concurrently the contact 239 and the contact 238 of the plate spring switch are connected. As a result of this, the contact 236 and the contact 238 are electrically connected and the electric power is supplied from the relay electric power source 60. The electric current flows to the coils 33 and 35 of the relays 31 and 32 and the relay contacts 34 and 36 are connected. The electric power is supplied from the high voltage electric power source 50 via the electric power jack terminals 221 and 222.

The receiving connector of the above-discussed embodiment includes a relay. In a case of the relay not having normal permanent magnets 225A, 225B, and others, it is difficult to break the arcing due to the high voltage. However, by providing the permanent magnets 225A and 225B as discussed in this embodiment, a problem of breaking the arcing even in the case of the high voltage such as 60 V or more can be solved. Hence, the receiving connector of this embodiment can be put into practical use even where the voltage is equal to or higher than 60 V.

The receiving connector of this embodiment, instead of the receiving connector of the first embodiment, can be used. A connector unit can be made by combining the receiving connector of this embodiment and the inserting connector of the first embodiment.

Fourth Embodiment

The fourth embodiment of the present invention is mainly related to the inserting connector. More specifically, in the fourth embodiment of the present invention, as discussed below, extension and retraction of the control plug is performed with a slide switch.

Figure 11:
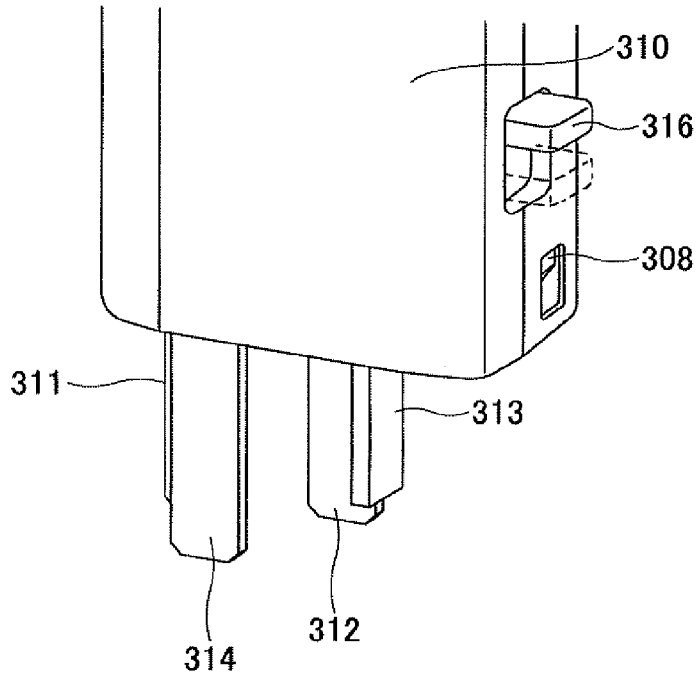
FIG. 11 is a perspective view of an internal structure of an inserting connector of a fourth embodiment of the present invention.
Figure 11:
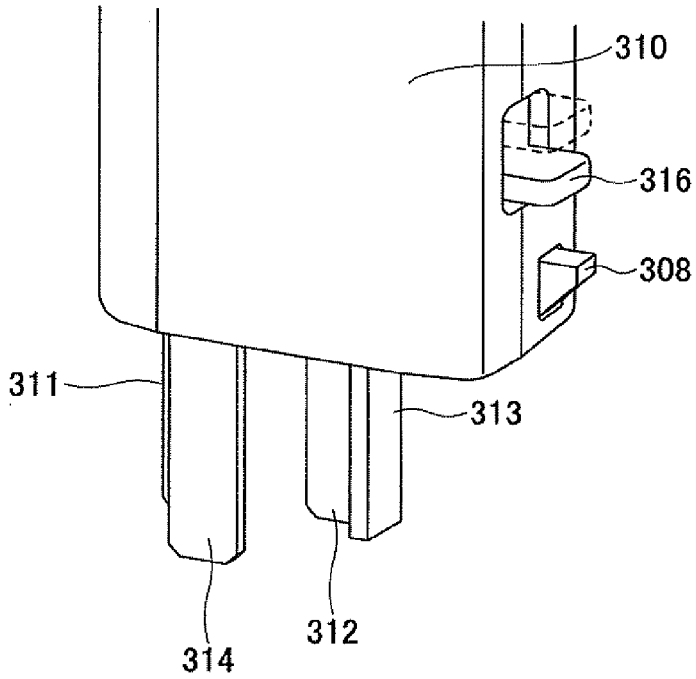

FIG. 11 shows a structure of the inserting connector of the fourth embodiment of the present invention. More specifically, FIG. 11(*a*) is a perspective view of an inserting connector 310 in a state where a control plug terminal 313 is retracted. FIG. 11(*b*) is a perspective view of the inserting connector 310 in a state where the control plug terminal 313 is extended.

The inserting connector 310 includes two electric power plug terminals 311 and 312 for receiving the supply of the electric power, a control plug terminal 313, a ground plug terminal 314, a slide switch 316, and a lock terminal 308.

The control plug terminal 313 is extended by sliding the slide switch 316 in the inserting direction of the control plug terminal 313 from the retracted state shown in FIG. 11(*a*) to the extended state shown in FIG. 11(*b*).

Figure 12:
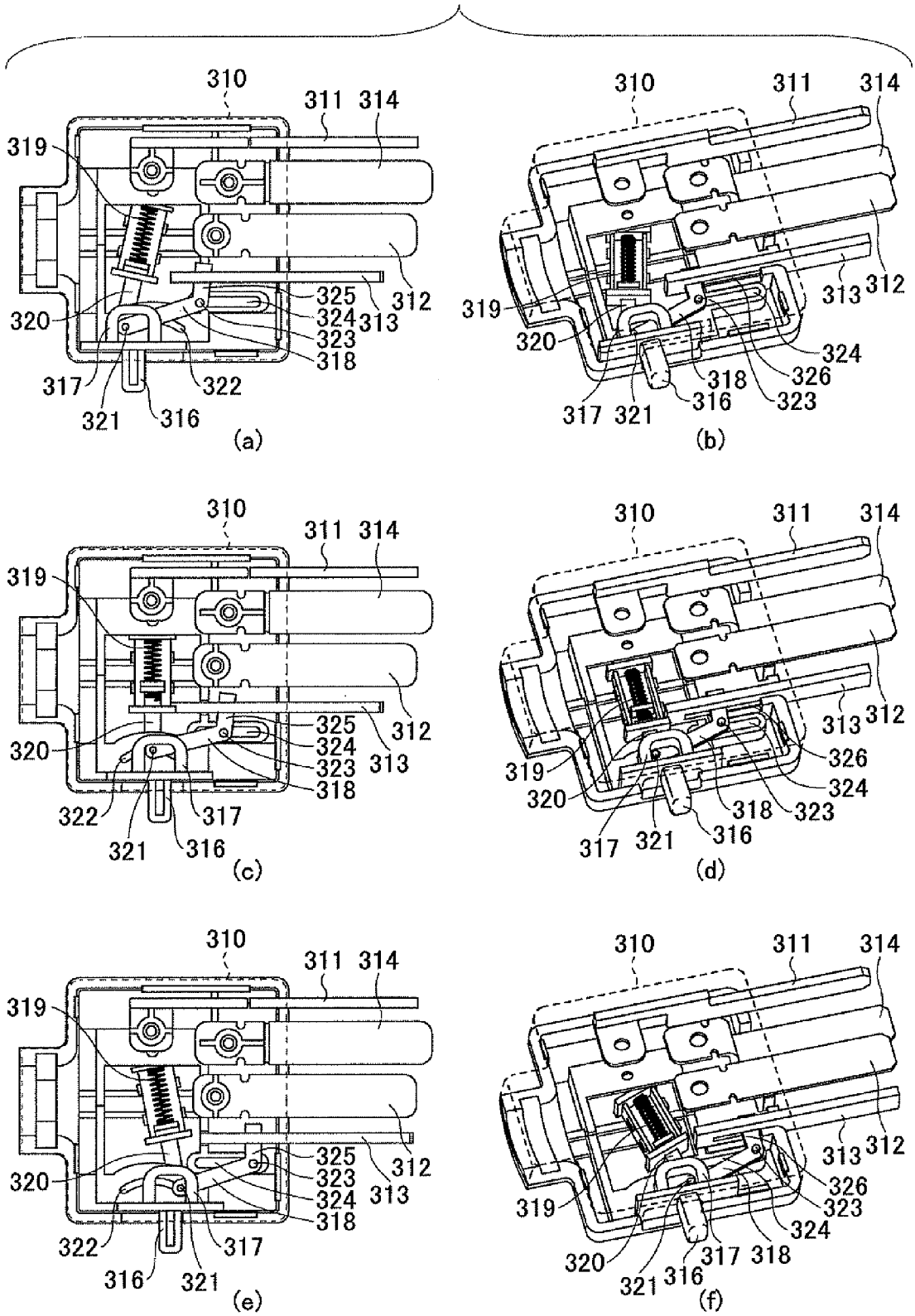
FIG. 12 is a view for explaining a case where a control plug terminal of an inserting connector of the fourth embodiment of the present invention is extended.
Figure 13:
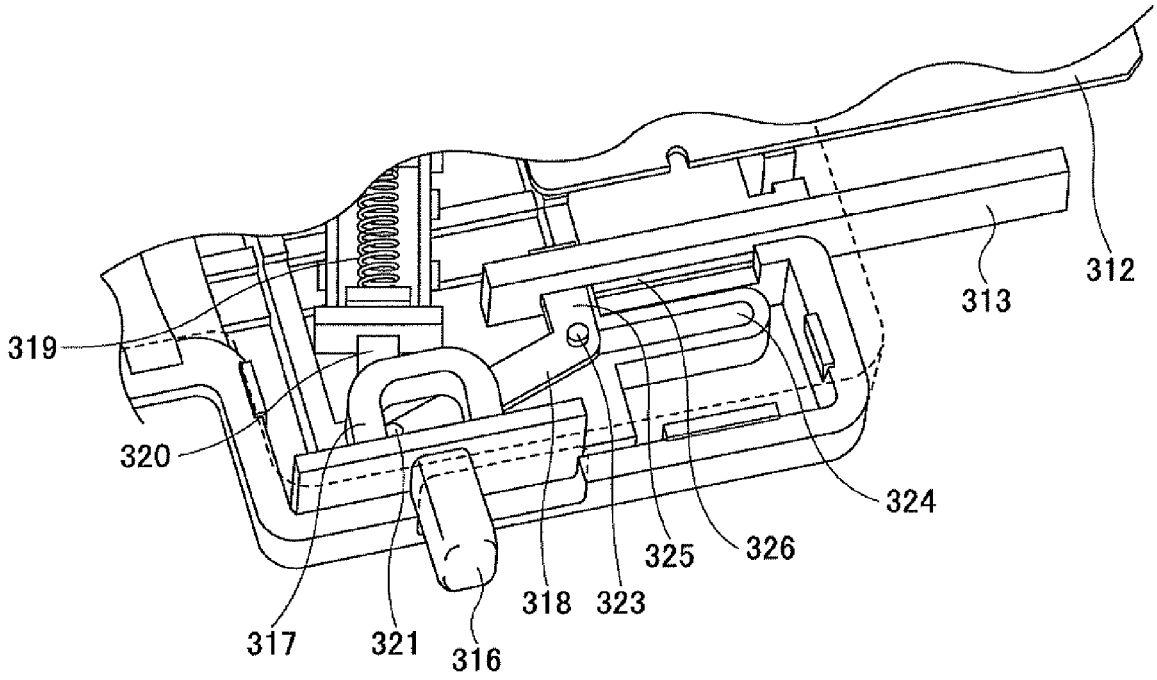
FIG. 13 is a perspective view of an internal structure of the inserting connector of the fourth embodiment of the present invention.

Next, with reference to FIG. 12 and FIG. 13, a case where the control plug terminal 313 is extended in the inserting connector 310 of this embodiment is discussed. By extending the control plug terminal 313, a contact of a switch provided at the control jack terminal of the receiving connector (not shown) is changed from open to closed.

FIG. 12(*a*) is an internal structural view of a state where the control plug terminal 313 is retracted. FIG. 12(*b*) is an internal perspective view of the state where the control plug terminal 313 is retracted. FIG. 12(*c*) is an internal structural view of an intermediate state between where the control plug terminal 313 is retracted and where the control plug terminal 313 is extended. FIG. 12(*d*) is an internal perspective view of the intermediate state between where the control plug terminal 313 is retracted and where the control plug terminal 313 is extended. FIG. 12(*e*) is an internal structural view of the state where the control plug terminal 313 is extended. FIG. 12(*f*) is an internal perspective view of the state where the control plug terminal 313 is extended. FIG. 13 is a partially expanded view of FIG. 12(*b*).

As shown in FIG. 12(*a*) and FIG. 12(*b*), in the slide switch 316, a U-shaped part 317 is provided inside the inserting connector 310. The control plug terminal 316 extends via a control plug terminal link 318.

In addition, a coil spring 319 is provided inside the inserting connector 310. The coil spring 319 is connected to one end of a transmitting part 320. The transmitting part 320 is configured to transmit the expansion and compression of the coil spring 319. Another end of the transmitting part 320 is connected to a cam shaft 321 of a control plug terminal link 318 where the end part of the transmitting part 320 can be rotated, and the cam shaft 321 can be moved in the cam groove 322.

Furthermore, a slide shaft 323 is provided in the control plug terminal link 318 to move in the slide groove 324. In addition, a head end part 325 of the control plug terminal link 318 is inserted in a buffer groove 326 provided in the control plug terminal 313 to move in the buffer groove 326.

In the state where the control plug terminal 313 is retracted, the slide switch 316 and the control plug terminal link 318 are positioned at a left side in FIG. 12. The cam shaft 321 is positioned on a most left side in the cam groove 322 and comes in contact with an internal part wall surface of the left side of the U-shaped part 317. Furthermore, the slide shaft 323 of the control plug terminal link 318 is positioned at a left side in the slide groove 324. A head end part 325 comes in contact with a left end of the buffer groove 326. At this time, the coil spring 319 is slightly compressed.

After this, the slide switch 315 is moved in the inserting direction (right direction in FIG. 12) to be in the intermediate state shown in FIG. 12(*c*) and FIG. 12(*d*). In this intermediate state, a moving direction of the slide switch 316 is perpendicular to expansion and compression directions of the coil spring 319.

In this intermediate state, the slide switch 316 is positioned in the substantially center part in FIG. 12. In the control plug terminal link 318, the cam shaft 321 is pushed to the right side by the internal part wall surface at the left side of the U-shaped part 317 in order to move to the right side in the cam groove 322 and reach the center part in the cam groove 322.

At this time, although the head end part 325 of the control plug terminal link 318 moves to a right side, the retracted state of the control plug terminal 313 is maintained because the head end part 325 moves in the buffer groove 326. In this retracted state, the head end part 325 comes in contact with a right end of the buffer groove 326. In addition, in this retracted state compared to the positions shown in FIG. 12(*a*) and FIG. 12(*b*), the coil spring 219 is compressed more and therefore a force pushing the transmitting part 320 up due to a restoring force of the coil spring 319 becomes stronger.

After this, by further moving the slide switch 316 in the inserting direction (right direction in FIG. 12), the positions shown in FIG. 12(*e*) and FIG. 12(*f*) are reached due to the restoring force of the coil spring 319.

In other words, due to the restoring force whereby the coil spring 319 expands, the cam shaft 321 moves in the cam groove 322 in the right direction in FIG. 12 via the transmitting part 320. As a result of this, via the head end part 325 of the control plug terminal link 318, the right end of the buffer groove 326 is pushed and the control plug terminal 313 extends in the inserting direction.

In this extended state, the slide switch 316 and the control plug terminal link 318 are moved to the right side in FIG. 12. Furthermore, the cam shaft 321 is moved to a most right side in the cam groove 322 and comes in contact with an internal part wall surface of the right side of the U-shaped part 317. Furthermore, the slide shaft 323 of the control plug terminal link 318 is positioned at a right side in the slide groove 324. The head end part 325 comes in contact with a right end of the buffer groove 326. At this time, the coil spring 319 is slightly expanded compared to the intermediate state.

Thus, it is possible to extend the control plug terminal 313 in the inserting direction. Since the control plug terminal 313 is extended in the inserting direction due to the restoring force of the coil spring 319 from the intermediate state, namely a force whereby the coil spring 319 is expanded, this occurs for a short period of time.

Figure 14:
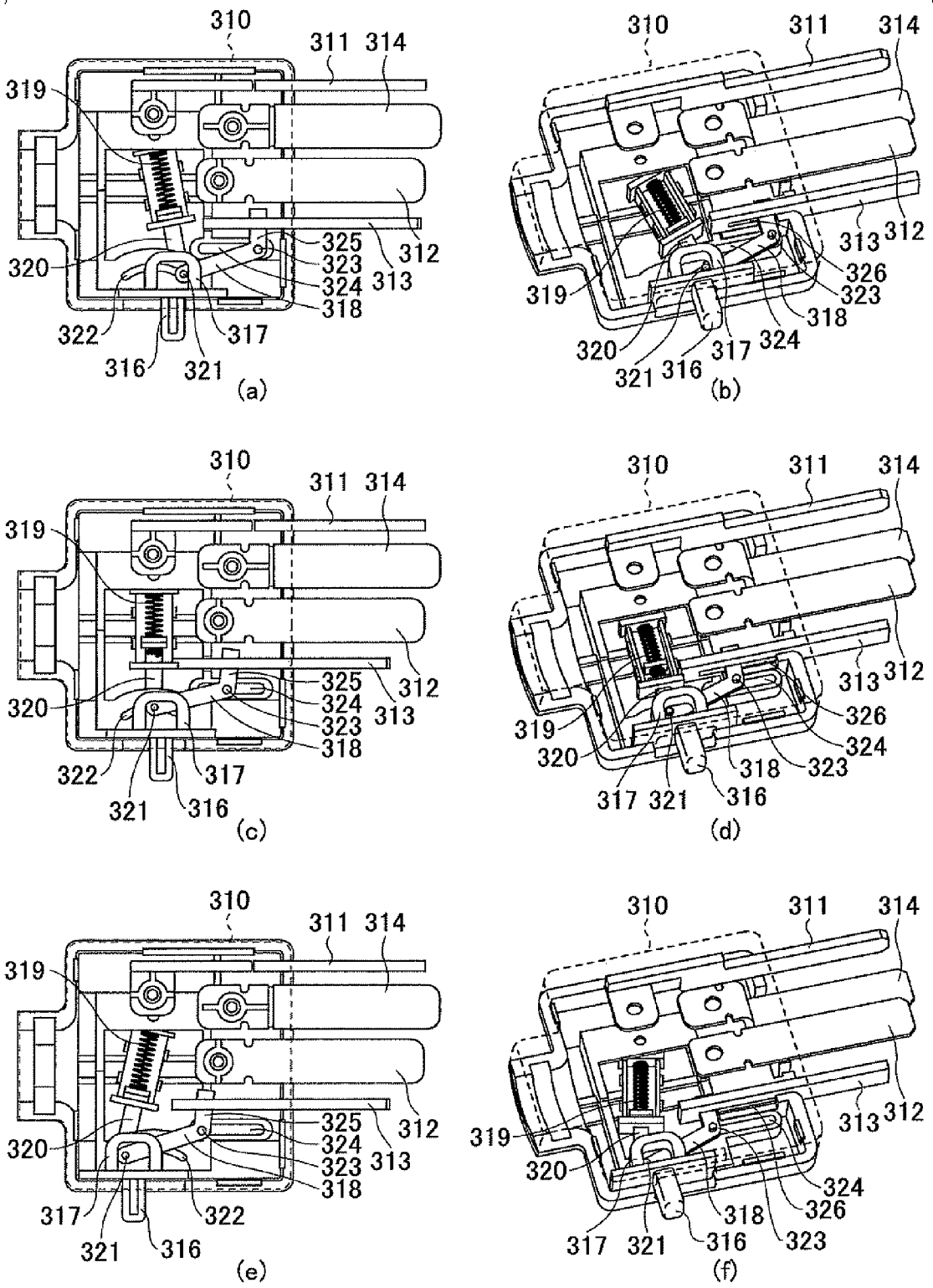
FIG. 14 is a view for explaining a case where the control plug terminal of the inserting connector of the fourth embodiment of the present invention is retracted.

Next, with reference to FIG. 14, a case where the control plug terminal 313 is retracted in the inserting connector 310 of this embodiment is discussed. By retracting the control plug terminal 313, a contact of a switch provided at the control jack terminal of the receiving connector (not shown) is changed from closed to open.

FIG. 14(*a*) is an internal structural view of a state where the control plug terminal 313 is extended. FIG. 14(*b*) is an internal perspective view of the state where the control plug terminal 313 is extended. FIG. 14(*c*) is an internal structural view of an intermediate state between where the control plug terminal 313 is extended and where the control plug terminal 313 is retracted. FIG. 14(*d*) is an internal perspective view of the intermediate state between where the control plug terminal 313 is extended and where the control plug terminal 313 is retracted. FIG. 14(*e*) is an internal structural view of the state where the control plug terminal 313 is retracted. FIG. 14(*f*) is an internal perspective view of the state where the control plug terminal 313 is retracted.

As shown in FIG. 14(*a*) and FIG. 14(*b*), in the state where the control plug terminal 313 is extended, the slide switch 316 and the control plug terminal link 318 are positioned at a right side in FIG. 14.

The cam shaft 321 is positioned at a rightmost side in the cam groove 322 and comes in contact with an internal part wall surface of the right side of the U-shaped part 317. Furthermore, the slide shaft 323 of the control plug terminal link 318 is positioned at a right side in the slide groove 324. A head end part 325 comes in contact with a right end of the buffer groove 326. At this time, the coil spring 319 is slightly compressed.

After this, the slide switch 315 is moved in the pulling direction (left direction in FIG. 14) to reach the intermediate state shown in FIG. 14(*c*) and FIG. 14(*d*). In this intermediate state, a moving direction of the slide switch 316 is perpendicular to an expansion and compression direction of the coil spring 319.

In this intermediate state, the slide switch 316 is positioned in the substantially center part in FIG. 14. In the control plug terminal link 318, the cam shaft 321 is pushed to the left side by the internal part wall surface at the right side of the U-shaped part 317 to move to the left side in the cam groove 322 and reach the center part in the cam groove 322.

At this time, although the head end part 325 of the control plug terminal link 318 moves to a left side, the extended state of the control plug terminal 313 is maintained because the head end part 325 moves in the buffer groove 326. In this extended state, the head end part 325 comes in contact with a right end of the buffer groove 326. In addition, in this extended state compared to the positions shown in FIG. 14(*a*) and FIG. 14(*b*), the coil spring 319 is compressed more and therefore a force pushing the transmitting part 320 up due to a restoring force of the coil spring 319 becomes stronger.

After this, by further moving the slide switch 316 in the pulling direction (left direction in FIG. 14), positions shown in FIG. 14(*e*) and FIG. 14(*f*) are attained due to the restoring force of the coil spring 319.

In other words, due to the restoring force whereby the coil spring 319 expands, the cam shaft 321 moves in the cam groove 322 in the left direction in FIG. 12 via the transmitting part 320. As a result of this, via the head end part 325 of the control plug terminal link 318, the left end of the buffer groove 326 is pushed and the control plug terminal 313 is retracted in the inserting direction.

In this retracted state, the slide switch 316 and the control plug terminal link 318 are moved to the left side in FIG. 14. Furthermore, the cam shaft 321 is moved to a leftmost side in the cam groove 322 and comes in contact with an internal part wall surface of the left side of the U-shaped part 317. Furthermore, the slide shaft 323 of the control plug terminal link 318 is positioned at a left side in the slide groove 324. The head end part 325 comes in contact with a left end of the buffer groove 326. At this time, the coil spring 319 is slightly expanded compared to the intermediate state.

Thus, it is possible to retract the control plug terminal 313 in the inserting direction. Since the control plug terminal 313 is retracted in the inserting direction due to the restoring force of the coil spring 319 from the intermediate state, namely a force whereby the coil spring 319 is expanded, this is performed for a short period of time.

In the meantime, in a case where the coil spring 319 is not provided, the control plug terminal 313 is retracted and extended in the inserting direction by only a force of a finger of a human. Since the speed for retracting or extending differs depending on the person operating the device, the speed may be slow.

Due to the speed for retracting or extending being slow, arcing or chattering may be generated at a contact of the receiving connector (not shown) connected by the control plug terminal 313. Such arcing or chattering may damage the contact of the receiving connector or an apparatus connected to the inserting connector.

In the receiving connector 310 of this embodiment, the control plug terminal 313 can be retracted or extended in a short period of time. Accordingly, the above-mentioned arcing or chattering can be prevented from being generated. Hence, it is possible to prevent the contact of the receiving connector or the apparatus connected to the inserting connector from being damaged.

Next, a mechanism of the inserting connector of the embodiment is discussed with reference to FIG. 15.

Figure 15:
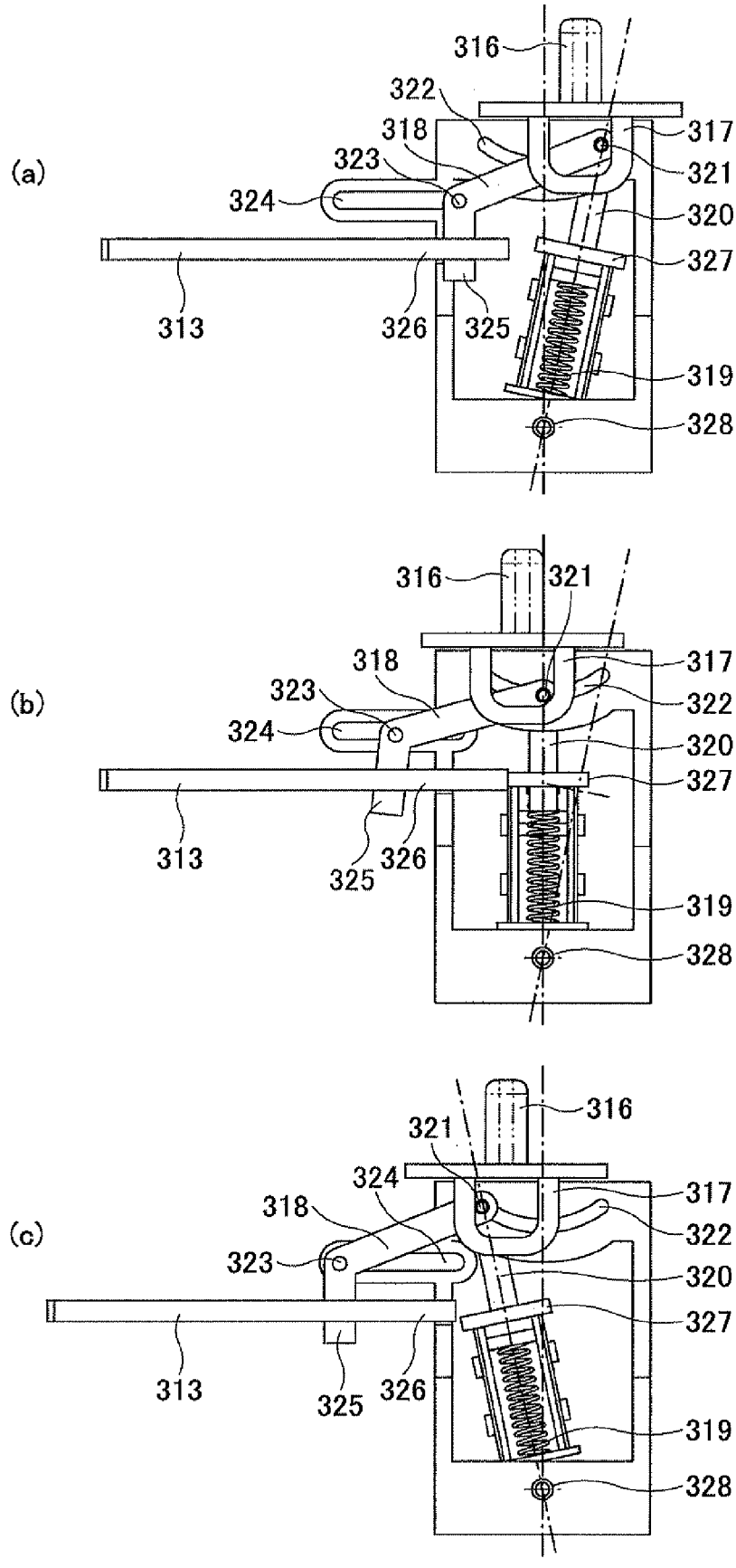
FIG. 15 is a partial cross-sectional view of the internal structure of the inserting connector of the fourth embodiment of the present invention.

FIG. 15(*a*) is a partial cross-sectional view of an inserting connector in the state where the control plug terminal 313 is retracted. FIG. 15(*b*) is a partial cross-sectional view of the inserting connector in the state where the control plug terminal 313 is in the intermediate state. FIG. 15(*c*) is a partial cross-sectional view of the inserting connector in the state where the control plug terminal 313 is extended.

The slide switch 316 is moved to the left side in FIG. 15(*a*) so that the cam shaft 321 is pushed to the left side by the internal part wall surface of the right side of the U-shaped part 317. As a result of this, the cam shaft 321 is moved to the left side in the cam groove 322 so that the control plug terminal link 318 is moved to the left side.

At this time, the coil spring 319 is compressed by the cam shaft 321 via the transmitting part 320. The coil spring 319 of the inserting connector 310 of this embodiment is received in the coil spring holder 327. An end of the coil spring 319 at a side not contacting the transmitting part 320 is fixed inside the coil spring holder 327. Furthermore, the coil spring holder 327 is rotatably supported by the housing of the inserting connector 310 and the rotational shaft 328.

As a result of this, the intermediate state shown in FIG. 15(*b*) is formed. In this state, the coil spring 319 is compressed and the restoring force in the extending direction is large.

After this, the slide switch 316 is further moved to the left side, and the transmitting part 320 is pushed up by the restoring force of the coil spring 319 so that the cam shaft 321 moves to the left side in the cam groove 322. As a result of this, the control plug terminal 313 is moved in the left direction via the head end part 325 of the control plug terminal link 318. In other words, the control plug terminal 313 is extended in the inserting direction so that the extended state shown in FIG. 15(*c*) is formed.

Thus, it is possible to push the control plug terminal 313 in a short period of time.

Similarly, in a case where the control plug terminal 313 is to be retracted, it is possible to retract the control plug terminal 313 from the intermediate state due to the restoring force of the coil spring 319. Hence, it is possible to retract the control plug terminal 313 in a short period of time.

In the above-discussed examples, by using a restoring force whereby the coil spring 319 is expanded from the compressed state, the control plug terminal 313 is retracted. However, by using a structure or the like of the cam groove 322, the restoring force whereby the coil spring 319 is compressed from the expanded state is used so that extension and retraction of the control plug terminal 313 can be performed.

In addition, although the coil spring 319 is used in the above-discussed examples, any elastic member can be used as long as the same action can be performed.

Furthermore, the inserting connector of this embodiment, instead of the inserting connector of the first embodiment, can be used. For example, the inserting connector of this embodiment can be combined with the receiving connector of the first embodiment or the third embodiment so that the connector unit can be formed.

In addition, in the above-discussed example, the case of 400 VDC is explained. However, the inserting connector, the receiving connector, and the connector unit can be used as long as the electric current is a direct current (DC). In the case of DC, unlike AC, there is no frequency so that it is safe for humans.

From the perspective of influence on the human body, a voltage equal to or less than 48 V is normally used as a direct current voltage. This is because there is almost no influence due to electric shock if the voltage is equal to or less than 48 V. If the voltage is higher than 48 V, the influence on human body is large and, especially, the voltage equal to or higher than 200 V is dangerous.

In the inserting connector, the receiving connector, and the connector unit of this embodiment, safety is improved by a structure different from the conventional art. Hence, safety in the case of the voltage higher than 48 V, especially the voltage higher than 200V is improved and therefore the receiving connector and the connector unit of this embodiment are effective.

According to the embodiments of the present invention, it is possible to provide an inserting connector, a receiving connector, and a connector unit whereby high voltage electric power can be safely supplied.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An inserting connector connected to a receiving connector, the receiving connector being configured to electrically connect an electric power source and an electric apparatus receiving an electric power supply from the electric power source, the inserting connector being connected to the electric apparatus, the inserting connector comprising:

two electric power plug terminals made of a conductor, the conductor being configured to receive the electric power supply; and a control plug terminal configured to be extended and retracted in an inserting direction;

wherein the receiving connector is connected to the electric power source;

the receiving connector includes two electric power jack terminals corresponding to the electric power plug terminals, a control jack terminal corresponding to the control plug terminal, and a relay connected to the control jack terminal, and the relay is operated by extending the control plug terminal in the inserting direction, so that the electric power is supplied to the electronic apparatus via the electric power plug terminal and the electric jack terminal.

2. The inserting connector as claimed in claim 1, wherein extension and retraction in the inserting direction of the control plug terminal is performed by a slide switch or a pushing button switch.

3. The inserting connector as claimed in claim 1, further comprising:

a slide switch configured to perform the extension and retraction in the inserting direction of the control plug terminal via a control plug terminal link, and an expandable and compressible coil spring, wherein the inserting connector is in an intermediate state where a moving direction of the slide switch is perpendicular to an expansion and compression direction of the coil spring; and the coil spring is expanded and compressed by moving the slide switch.

4. The inserting connector as claimed in claim 3, wherein the coil spring is in an expanded state or a compressed state in the case of the intermediate state; and the control plug terminal is extended in the inserting direction via the control plug terminal link by a restoring force of the coil spring from the intermediate state.

5. The inserting connector as claimed in claim 3, wherein the coil spring is in an expanded state or a compressed state in the case of the intermediate state; and the control plug terminal is retracted in the inserting direction via the control plug terminal link by a restoring force of the coil spring from the intermediate state.

6. The inserting connector as claimed in claim 1, further comprising:

a lock terminal configured to project in a direction perpendicular to the inserting direction, corresponding to the extension and retraction in the inserting direction of the control plug terminal, wherein the lock terminal projects in the direction perpendicular to the inserting direction by extending the plug terminal in the inserting direction;

the receiving connector includes a concave part having a configuration corresponding to the projected lock terminal; and by extending the control plug terminal in a state where the inserting connector and the receiving connector are engaged with each other, the lock terminal is engaged into the concave part of the receiving connector in the direction perpendicular to the inserting direction, so that an engaging state of the inserting connector and the receiving connector is maintained.

7. The inserting connector as claimed in claim 1, further comprising:

a ground plug terminal;

wherein the receiving connector includes a ground jack terminal corresponding to the ground plug terminal; and the ground plug terminal and the ground jack terminal are engaged with each other in the engaging state where the inserting connector and the receiving connector are engaged with each other.

8. The inserting connector as claimed in claim 1, wherein the electric power supplied from the electric power source is direct current.

9. The inserting connector as claimed in claim 1, wherein a voltage of the electric power supplied from the electric power source is higher than 48 V.

10. A receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector comprising:

two electric power jack terminals corresponding to the electric power plug terminals;

a control jack terminal corresponding to the control plug terminal; and a relay connected to the control jack terminal, wherein the relay is operated by extending the control plug terminal in the inserting direction, so that the electric power is supplied to the electronic apparatus via the electric power plug terminal and the electric jack terminal.

11. The receiving connector as claimed in claim 10, wherein the inserting connector further includes a lock terminal to project in a direction perpendicular to the inserting direction, corresponding to the extension and retraction in the inserting direction of the control plug terminal, wherein the lock terminal projects in the direction perpendicular to the inserting direction by extending the plug terminal in the inserting direction;

the receiving connector includes a concave part having a configuration corresponding to the projected lock terminal; and by extending the control plug terminal in a state where the inserting connector and the receiving connector are engaged with each other, the lock terminal is engaged into the concave part of the receiving connector in the direction perpendicular to the inserting direction, so that an engaging state of the inserting connector and the receiving connector is maintained.

12. The receiving connector as claimed in claim 10, wherein the inserting connector further includes a ground plug terminal;

wherein the receiving connector includes a ground jack terminal corresponding to the ground plug terminal; and the ground plug terminal and the ground jack terminal are engaged with each other in a state where the inserting connector and the receiving connector are engaged with each other.

13. The inserting connector as claimed in claim 10, wherein the electric power supplied from the electric power source is direct current.

14. The inserting connector as claimed in claim 10, wherein a voltage of the electric power supplied from the electric power source is higher than 48 V.

15. A receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector comprising:

two electric power jack terminals corresponding to the electric power plug terminals;

a control jack terminal corresponding to the control plug terminal; and a relay including at least one coil and two relay contacts, wherein the two relay contacts are simultaneously connected by flowing an electric current to the coil;

the two relay contacts are connected, corresponding to the two electric power jack terminals;

the electric power source is configured to supply the electric power from the electric jack terminals via the two relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

16. The receiving connector as claimed in claim 15, wherein the control plug terminal is made of a conductor; and the two control electrodes come in contact with each other by extending the control plug terminal in the inserting direction, so that the two control electrodes are electrically connected to each other via the control plug terminal.

17. The receiving connector as claimed in claim 15, wherein the two control electrodes are two terminals of a switch; and the two terminals of the switch are connected to each other by extending the control plug terminal in the inserting direction.

18. A receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply, and a control plug terminal configured to be extended and retracted in an inserting direction;

the receiving connector being connected to the electric power source, the receiving connector comprising:

two electric power jack terminals corresponding to the electric power plug terminals;

a control jack terminal corresponding to the control plug terminal; and two relays, each of the relays including a coil and a relay contact, wherein the relay contacts are connected by flowing an electric current to the coils;

the relay contacts of the two relays are connected, corresponding to the two electric power jack terminals;

the electric power source is configured to supply the electric power from the electric power jack terminals via the relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, the electric current flows in the coils, and thereby the two relay contacts are connected and the electric power is supplied to the electronic apparatus.

19. A connector unit configured to electrically connect an electric power source and an electric apparatus receiving an electric power supply from the electric power source, the connector unit comprising:

an inserting connector connected to the electronic apparatus; and a receiving connector connected to the electric power source, wherein the inserting connector includes two electric power plug terminals made of a conductor, the conductor being configured to receive the electric power supply; and a control plug terminal configured to be extended and retracted in an inserting direction;

the receiving connector includes two electric power jack terminals corresponding to the electric power plug terminals, a control jack terminal corresponding to the control plug terminal, and a relay connected to the control jack terminal; wherein the relay is operated by extending the control plug terminal in the inserting direction so that the electric power is supplied to the electronic apparatus via the electric power plug terminal and the electric jack terminal.

20. The connector unit as claimed in claim 19, wherein extension and retraction in the inserting direction of the control plug terminal is performed by a slide switch or a pushing button switch.

21. The connector unit as claimed in claim 19, further comprising:

a slide switch configured to perform extension and retraction in the inserting direction of the control plug terminal via a control plug terminal link, and a expandable and compressible coil spring, wherein the inserting connector is in an intermediate state where a moving direction of the slide switch is perpendicular to an expansion and compression direction of the coil spring; and the coil spring is expanded and compressed by moving the slide switch.

22. The connector unit as claimed in claim 21, wherein the coil spring is in an expanded state or a compressed state in the case of the intermediate state; and the control plug terminal is extended in the inserting direction via the control plug terminal link by a restoring force of the coil spring from the intermediate state.

23. The connector unit as claimed in claim 21, wherein the coil spring is in an expanded state or a compressed state in the case of the intermediate state; and the control plug terminal is retracted in the inserting direction via the control plug terminal link by a restoring force of the coil spring from the intermediate state.

24. The connector unit as claimed in claim 19, further comprising:

a lock terminal configured to project in a direction perpendicular to the inserting direction, corresponding to the extension and retraction in the inserting direction of the control plug terminal, wherein the lock terminal projects in the direction perpendicular to the inserting direction by extending the plug terminal in the inserting direction;

the receiving connector includes a concave part having a configuration corresponding to the projected lock terminal; and by extending the control plug terminal in a state where the inserting connector and the receiving connector are engaged with each other, the lock terminal is engaged into the concave part of the receiving connector in the direction perpendicular to the inserting direction, so that the engaging state of the inserting connector and the receiving connector is maintained.

25. The connector unit as claimed in claim 19, further comprising:

a ground plug terminal;

wherein the receiving connector includes a ground jack terminal corresponding to the ground plug terminal; and the ground plug terminal and the ground jack terminal are engaged with each other in a state where the inserting connector and the receiving connector are engaged with each other.

26. The inserting connector as claimed in claim 19, wherein the electric power supplied from the electric power source is direct current.

27. The inserting connector as claimed in claim 19, wherein a voltage of the electric power supplied from the electric power source is higher than 48 V.

28. A connector unit configured to electrically connect an electric power source and an electric apparatus receiving an electric power supply from the electric power source, the connector unit comprising:

an inserting connector connected to the electronic apparatus; and a receiving connector connected to the electric power source, wherein the inserting connector includes two electric power plug terminals made of a conductor, the conductor being configured to receive the electric power supply, and a control plug terminal configured to be extended and retracted in an inserting direction;

the receiving connector includes two electric power jack terminals corresponding to the electric power plug terminals;

a control jack terminal corresponding to the control plug terminal; and a relay including at least one coil and two relay contacts, wherein the two relay contacts are simultaneously connected by flowing an electric current to the coil;

the two relay contacts are connected, corresponding to the two electric power jack terminals;

the electric power source is configured to supply the electric power from the electric jack terminals via the two relay contacts;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

29. The connector unit as claimed in claim 28, wherein the control plug terminal is made of a conductor; and the two control electrodes come in contact with each other by extending the control plug terminal in the inserting direction, so that the two control electrodes are electrically connected to each other via the control plug terminal.

30. The connector unit as claimed in claim 28, wherein the two control electrodes are two terminals of a switch; and the two terminals of the switch are connected to each other by extending the control plug terminal in the inserting direction.

31. A connector unit configured to electrically connect an electric power source and an electric apparatus receiving an electric power supply from the electric power source, the connector unit comprising:

an inserting connector connected to the electronic apparatus; and a receiving connector connected to the electric power source, wherein the inserting connector includes two electric power plug terminals made of a conductor, the conductor being configured to receive the electric power supply, and a control plug terminal configured to be extended and retracted in an inserting direction;

the receiving connector includes two electric power jack terminals corresponding to the electric power plug terminals;

a control jack terminal corresponding to the control plug terminal; and two relays, each of the relays including a coil and a relay contact, the relay contacts are connected by flowing an electric current to the coil;

the relay contacts of the two relays are connected, corresponding to the two electric power jack terminals;

the electric power source is configured to supply the electric power from the electric jack terminal via the relay contact;

the control jack terminal includes two control electrodes configured to flow the electric current to the coil; and the two control electrodes are connected to each other by extending the control plug terminal in the inserting direction to the control jack terminal in a state where the two electric power plug terminals and the two electric power jack terminals are engaged with each other, so that the electric current flows in the coil, and thereby the two relay contacts are connected and the electric power is supplied to the electronic apparatus.

* * * * *